US005778291A

United States Patent [19]

Okubo et al.

[11] Patent Number: 5,778,291

[45] Date of Patent: Jul. 7, 1998

[54] IMAGE FORMING APPARATUS HAVING A TRANSFER MEMBER POSITIONAL DOWNSTREAM OF A NIP PORTION

[75] Inventors: Masao Okubo; Noriaki Kojima; Nobukazu Takahashi, all of Ebina, Japan

[73] Assignee: Fuji Xerox Co., Ltd., Tokyo, Japan

[21] Appl. No.: 716,567

[22] Filed: Sep. 19, 1996

[30] Foreign Application Priority Data

Sep. 26, 1995 [JP] Japan ..... 7-247993
Sep. 6, 1996 [JP] Japan ..... 8-236934

[51] Int. Cl.[6] ..... G03G 15/16

[52] U.S. Cl. ..... 399/302; 399/299; 399/313

[58] Field of Search ..... 399/299, 302, 399/303, 308, 310, 312, 313, 318, 316

[56] References Cited

U.S. PATENT DOCUMENTS

| | | | |
|---|---|---|---|
| 4,162,843 | 7/1979 | Inoue et al. | 399/299 X |
| 5,006,902 | 4/1991 | Araya | 399/313 X |
| 5,099,286 | 3/1992 | Nishise et al. | 399/302 |
| 5,159,390 | 10/1992 | Imaizumi | 399/308 X |
| 5,270,770 | 12/1993 | Kukimoto et al. | 399/313 |
| 5,365,324 | 11/1994 | Gu et al. | 399/299 |
| 5,386,286 | 1/1995 | Kinouchi et al. | 399/299 X |
| 5,469,248 | 11/1995 | Fujiwara et al. | 399/313 X |
| 5,512,986 | 4/1996 | Toyomura et al. | 399/308 X |
| 5,515,145 | 5/1996 | Sasaki et al. | 399/302 |
| 5,515,146 | 5/1996 | Harasawa et al. | 399/310 |
| 5,602,633 | 2/1997 | Yoshida et al. | 399/299 |

FOREIGN PATENT DOCUMENTS

| | | |
|---|---|---|
| A6-95521 | 4/1994 | Japan . |
| A6-95536 | 4/1994 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

An image forming apparatus includes: a latent image carrier 1 to form a latent image in accordance with an image signal; a developing unit 14 to develop the latent image with a predetermined toner; an intermediate transfer body 2 coming into contact with the latent image carrier 1 so that the intermediate transfer body can be rotated together with the latent image carrier, the intermediate transfer body being capable of transferring a toner image formed on the latent image carrier 1; a transfer roller 4 to simultaneously transfer the toner image held on the intermediate transfer body 2 onto a recording medium 11; and a transfer roller 3 arranged in the downstream close to a contact region (nip portion) of the latent image carrier 1 with the intermediate transfer body 2, the transfer roller 3 being arranged on a side of the intermediate transfer body 2 reverse to a toner image holding surface so as to transfer the toner image on the intermediate transfer body 2 by forming a transfer electric field between the latent image carrier 1 and the intermediate transfer body 2 when a voltage, the polarity of which is opposite to the electrical charging polarity of the toner image, is impressed.

16 Claims, 13 Drawing Sheets

IMAGE FORMING APPARATUS HAVING A TRANSFER MEMBER POSITIONAL DOWNSTREAM OF A NIP PORTION

BACKGROUND OF THE INVENTION

1. Field of the Invention

The present invention relates to an image forming apparatus such as an electrophotographic copier and printer, and more particularly relates to an image forming apparatus in which a toner image formed on a latent image carrier, which has not been fixed yet, is directly transferred onto a recording medium conveyed by a belt member, or indirectly transferred onto a recording medium via a belt-shaped intermediate transfer body.

2. Description of the Related Art

Concerning an image transfer method used for an image forming apparatus such an electrophotographic copier and printer, the following two methods are conventionally known. One is a method in which a toner image formed on a latent image carrier such as a photoreceptor drum is directly transferred onto a recording medium conveyed by a belt-shaped conveying body, and the other is a method in which a toner image formed on a latent image carrier is primarily transferred onto a drum-shaped intermediate transfer body or an endless-belt-shaped intermediate transfer body, and then the toner image on the intermediate transfer body is secondarily transferred onto a recording medium so that a copied image can be obtained.

In the following explanations, a member to come into contact with a latent image carrier so as to form a transfer nip portion (referred to as a nip portion hereinafter), such as a belt-shaped conveyance body, intermediate transfer belt and endless belt provided in a drum-shape will be referred to as a belt member hereinafter in this specification.

FIG. 18 is a schematic illustration showing a general construction of the primary portion of the color printer which is an example of the image forming apparatus in which an intermediate transfer body is used as the belt member. Reference numeral 1 is a latent image carrier (photoreceptor drum in this case), reference numeral 2 is a belt-shaped intermediate transfer body (referred to as an intermediate transfer belt hereinafter) which is a belt member, reference numeral 2*a* is a drive roller, reference numerals 2*b*, 2*c* are idle rollers, reference numeral 2*d* is a tension roller, reference numeral 3 is a primary transfer roller, reference numeral 4 is a secondary transfer roller, reference numeral 5 is a backup roller composing a rotating means for rotating the intermediate transfer belt 2 and also composing an electrode opposed to the secondary transfer roller 4, reference numeral 10 is an intermediate transfer belt cleaner, reference numeral 11 is a recording medium such as a sheet of transfer paper, reference numeral 13 is a charger for uniformly charging the photoreceptor drum by an electric charge of a predetermined polarity, reference numeral 14 is a color developing apparatus having a plurality of developing units of a plurality of colors (black Bk, cyan C, magenta M and yellow Y in this case), reference numeral 17 is a register roller for feeding the recording medium 11, which has been picked up from an accommodation tray to accommodate the recording mediums, to a contact position (secondary transfer section) of the secondary transfer roller 4 with the intermediate transfer belt 2 in a predetermined timed relation, reference numeral 24 is a cleaner for cleaning the photoreceptor drum, and reference numeral 25 is a discharger for discharging an electric charge on the surface of the photoreceptor drum 1.

In the drawing, the surface of the photoreceptor drum 1 is uniformly charged with an electric charge of a predetermined polarity by the charger 13. Accordingly, by the writing scanning operation conducted by laser beams L modulated by an image signal of the first color, an electrostatic latent image corresponding to an image of the first color (for example, yellow) can be formed on the surface of the photoreceptor drum 1.

When the photoreceptor drum 1 is rotated by one revolution, this electrostatic latent image is conveyed to a position at which the developing apparatus 14 is arranged. Then the electrostatic latent image is developed by the developing unit with the toner of the first color, and the photoreceptor drum, on the surface of which the developed toner image is carried, is further rotated.

In accordance with the toner developing motion described above, the intermediate transfer belt 2 is moved at the substantially same circumferential speed as that of the photoreceptor drum 1. In the primary transfer section composed of the primary transfer roller 3 which comes into contact with the intermediate transfer belt 2 immediately below the nip position where the photoreceptor drum 1 is contacted with the intermediate transfer belt 2, the toner image carried by the photoreceptor drum 1 is primarily transferred onto the intermediate transfer belt 2 by the action of a transfer electric field, the polarity of which is reverse to the charging polarity of toner, impressed upon the primary transfer roller 3. This transfer cycle is referred to as a first transfer cycle.

The toner image which has been primarily transferred onto the intermediate transfer belt 2 is conveyed to the secondary transfer section, in which the secondary transfer roller 4 is arranged, when the intermediate transfer belt 2 is rotated.

In the case of a full color copier, a color toner image is formed when the operation, which includes formation of a latent image on the photoreceptor drum, development of the latent image conducted by toner and primary transfer of the toner image, is repeated by the frequency corresponding to the number of predetermined colors (yellow: Y, cyan: C, magenta: M and black: BK) so that multi-color toner images can be superimposed on the intermediate transfer belt 2.

In general, the developing apparatus 14 arranged in the color image forming apparatus includes a Bk developing unit, cyan developing unit, magenta developing unit and yellow developing unit, that is, the developing apparatus 14 is composed of the developing units of 4 colors. The developing unit of each toner color is selectively positioned at a developing position so that the latent image of each color formed on the photoreceptor drum 1 can be successively developed, or alternatively the developing positions are successively arranged around the photoreceptor drum 1.

After the toner image of the first color carried on the photoreceptor drum 1 has been transferred onto the intermediate transfer belt 2 at the position of the primary transfer unit 3, the residual toner on the photoreceptor drum 1 is removed by the latent image carrier cleaner 24, and the residual electric charge on the photoreceptor drum 1 is neutralized by the discharger 25. After that, the latent image of the second color is formed.

The latent image of the second color (for example, magenta) is developed in the same manner as that of the first color. The toner image of the second color is transferred and superimposed on the toner image of the first color which has previously been transferred onto the intermediate transfer belt 2.

The toner images of the third color (cyan) and the fourth color (black) are transferred onto the intermediate transfer belt 2 in the same manner. As a result, on the intermediate transfer belt 2, there is formed a color toner image on which toner images of a plurality of colors, which have not been fixed yet, are superimposed. This transfer cycle is referred to as a secondary transfer cycle.

In this connection, the secondary transfer roller 4, intermediate transfer body cleaner 10 and separation claw are withdrawn from the intermediate transfer belt 2 until the transfer of the final toner image is completed.

At a point of time when the intermediate transfer belt 2, onto which all necessary color toner images have been primarily transferred, is conveyed to the secondary transfer roller 4, the recording medium 11, which has been sent out from the tray by the register roller 17 in timed relation with the transfer of the toner image, is fed between the intermediate transfer belt 2 and the secondary transfer roller 4.

When the recording medium 11 is conveyed by the secondary transfer roller 4, intermediate transfer belt 2 and backup roller 5, the toner image on the intermediate transfer belt 2 is secondarily transferred onto the recording medium 11 by the action of a transfer electric field formed by a transfer voltage, the polarity of which is reverse to the charging polarity of the toner image, impressed upon between the secondary transfer roller 4 and the intermediate transfer belt 2.

The secondary transfer roller 4 is made of conductive material and given a predetermined transfer voltage by a transfer power source not shown in the drawing. For example, a transfer current path is formed as follows. The secondary transfer roller 4 is connected to the transfer power supply, and the contact roller 6, which is arranged coming into contact with the backup roller 4 so that the contact roller can be rotated together with the backup roller 4, is grounded. In this connection, the contact roller 6 may be connected to the transfer power supply, and the secondary transfer roller 4 may be grounded.

The recording medium 11 onto which the toner image has been secondarily transferred is separated from the intermediate transfer belt 2 by the separation claw 19 and sent to the fixing unit 20. By the fixing unit 20, the toner image is fixed when the recording medium 11 is made to pass between a pair of fixing rollers while it is heated. Then the recording medium 11 is delivered onto the delivery tray 21. In this way, the image formation process is completed.

When the intermediate transfer belt 2 passes through the intermediate transfer body cleaner 10 after the completion of secondary transfer, the residual toner on the intermediate transfer belt 2 is removed so as to prepare for the next image formation process.

In the image forming apparatus in which the intermediate transfer belt 2 is used, a synthesized toner image (an image formed by superimposing toner images of different colors) is transferred onto the recording medium 11 all at once. Accordingly, unlike a transfer system in which toner images of different colors are successively, directly transferred from the latent image carrier 1 to the recording medium 11, it is possible to effectively prevent the occurrence of disarrangement and blur of toner images when the above transfer system is adopted.

Conventionally, Japanese Unexamined Patent Publication No. Hei 6-95521 discloses this type image forming apparatus.

In the primary transfer section in the above image formation process, the toner image (yellow toner image) that has been first transferred onto the intermediate transfer belt is affected by the transfer electric fields formed when the second color toner image (magenta), the third color toner image (cyan) and the fourth color toner image (black) are successively transferred. Accordingly, a quantity of electric charge on the toner image of each color is increased by the transfer electric field when the toner images of the above colors are successively transferred.

FIG. 19 is a graph to explain a change in the quantity of electric charge on the toner image of the first color (yellow) in the primary transfer cycle conducted on the intermediate transfer belt.

As shown in the drawing, the quantity of electric charge on the yellow toner image, which is the first toner color image primarily transferred onto the intermediate transfer belt 2, is gradually increased each time the toner images of the second color (magenta), the third color (cyan) and the fourth color (black) are primarily transferred.

After the toner image of the second color (magenta) has been superimposed on the yellow image of the first color on the intermediate transfer belt, or alternatively after the toner image of the second color (magenta) has been primarily transferred onto a portion on the intermediate transfer belt where no yellow image is formed, the quantity of electric charge is successively increased each time the primary transfer of the third color (cyan) and the fourth color (black) is carried out.

In the same manner, after the toner image of the third color (cyan) has been primarily transferred, the quantity of the electric charge of the third color toner image is increased by the action of the transfer electric field generated in the primary transfer of the toner image of the fourth color (black).

However, the quantity of electric charge of the toner image of the fourth color (black), which is the final color, is maintained at a value in the case of primary transfer, because no toner is transferred onto the toner image of the fourth color (black).

As described above, as shown in the drawing, the quantity of electric charge on the yellow toner image is maximum, and the order of the quantity of electric charge on the toner image is magenta, cyan and black.

In the secondary transfer operation, a plurality of toner images, the quantities of electric charges of which are different, are simultaneously transferred onto a recording medium. In this secondary transfer operation, the optimum transfer voltage with respect to the toner image formed on the intermediate transfer belt 2 is determined in accordance with the quantity of electric charge on the toner image.

FIG. 20 is a graph to explain a relation between the quantity of electric charge of the toner on the intermediate transfer belt and the optimum secondary transfer voltage. In this graph, the horizontal axis represents a quantity of electric charge (μm/g) of toner on the intermediate transfer belt, and the vertical axis represents an optimum secondary transfer voltage (KV).

As shown in the graph, the quantity of electric charge of the toner on the intermediate transfer belt is substantially in direct proportion to the optimum secondary transfer voltage.

That is, when the toner, the quantity of electric charge of which is large, is transferred, it is necessary to increase the transfer voltage, and when the toner, the quantity of electric charge of which is small, is transferred, it is necessary to decrease the transfer voltage.

When the secondary transfer is conducted by a transfer voltage higher than the optimum transfer voltage, in a portion on the intermediate transfer belt where a quantity of toner is small, a transfer current flows to the toner on the intermediate transfer belt when an intensity of the secondary transfer current is excessively high. Accordingly, the toner charging polarity is changed, which causes a defective transfer.

On the other hand, when the secondary transfer is conducted by a transfer voltage lower than the optimum transfer voltage, the transfer efficiency is lowered.

As described above, in the full color image forming apparatus in which the intermediate transfer belt is used, it is impossible to set an optimum condition of the secondary transfer voltage with respect to a plurality of toner images.

When the transfer roller is arranged immediately below the photoreceptor drum, the following problems may be encountered. In accordance with the rotation of the intermediate transfer belt and the photoreceptor drum, the transfer roller is vibrated in the upward and downward direction. Due to this vibration, transfer can not be conducted uniformly, and an electric field is formed at the nip portion between the intermediate transfer belt and the photoreceptor drum. By the action of this electric field, toner is scattered on the photoreceptor drum, that is, blur is caused on the transferred image.

In order to solve the above problems, the following prior art is disclosed in Japanese Unexamined Patent Publication No. Hei 6-95536. In the primary transfer section, the transfer roller is arranged in the downstream of the outer circumference of the photoreceptor drum in the conveyance direction of the intermediate transfer belt.

That is, when the transfer roller is arranged in the downstream of the outer circumference of the photoreceptor drum in the conveyance direction of the intermediate transfer belt, a peeling discharge phenomenon is caused when the photoreceptor drum and the intermediate transfer belt are peeled from each other. As a result, a quantity of electric charge of toner on the intermediate transfer belt is increased after the completion of transfer.

FIG. 21 is a schematic illustration showing a positional relation among the photoreceptor drum, intermediate transfer belt and primary transfer roller in the primary transfer section disclosed in the prior art described above. In the drawing, reference numeral 1 is a photoreceptor drum, reference numeral 2 is an intermediate transfer belt, and reference numeral 3 is a primary transfer roller.

The primary transfer roller 3 is arranged at a position in the downstream of the contact portion where the photoreceptor drum 1 is contacted with the intermediate transfer belt 3, wherein the position at which the primary transfer roller 3 is arranged is shifted by an angle θ in the outer circumferential direction of the photoreceptor drum. In this arrangement, the primary transfer roller 3 pushes the intermediate transfer belt 2 together with the photoreceptor drum 1.

When the primary transfer roller is arranged in the manner described above, the peeling discharge phenomenon is increased when the intermediate transfer belt 2 is separated from the photoreceptor drum 1. According to this peeling discharge phenomenon, a quantity of electric charge of toner on the intermediate transfer belt is increased.

Therefore, according to the above arrangement, a quantity of electric charge of black toner, which is the final color, is increased. Even if the secondary transfer voltage is set, for example, at 1.6 KV, it is possible to obtain an excellent transfer property with respect to toner of all colors from yellow to black.

However, according to the arrangement shown in FIG. 21, the intermediate transfer belt, to which a high tension is applied, is deflected. Therefore, the nip pressure is increased in the primary transfer.

FIG. 22 is a graph to explain a relation between the transfer image quality and the nip pressure generated between the intermediate transfer belt and the photoreceptor drum. In the graph, the horizontal axis represents a nip pressure (g/cm), and the vertical axis represents a grade of the transfer quality.

As shown by a solid line in the graph, when the nip pressure between the intermediate transfer belt and the photoreceptor drum is increased, the occurrence of whitening, which is a failure in transfer, is increased. As shown by a broken line in the graph, when the nip pressure is decreased to a value lower than a predetermined one, the occurrence of blur of transfer is increased.

Since a transfer member is arranged immediately below the nip portion formed between the photoreceptor drum and the intermediate transfer belt, the transfer member is vibrated by the movement of the photoreceptor drum and the intermediate transfer belt which are pushed to each other. This vibration causes a fluctuation of the nip pressure. As a result, blur of a transferred image is necessarily caused.

Further, an electric field is extended from the transfer member to an upstream region (pre-nip portion) located close to the nip portion between the photoreceptor drum and the intermediate transfer belt. By the action of this extended electric field, the toner is scattered, which causes blur of a transferred image. As a result, the image quality is deteriorated.

In the above explanations, the toner image formed on the latent image carrier is transferred onto a recording medium via the intermediate transfer belt. However, the circumstances are the same as those in the case of a color image forming apparatus in which color images respectively formed on a plurality of latent image carriers are successively superimposed on a recording medium conveyed in tandem by the respective sheet conveyance belts. Also, the circumstances are the same as those in the case of a monochromatic image forming apparatus in which a belt-shaped or film-shaped or such a type of transfer belt (belt member) is contacted with the latent image carrier such as a photoreceptor drum, and the toner image is directly transferred onto a recording medium.

As described above, according to the prior art, the transfer means is arranged immediately below the nip portion formed by the latent image carrier and the transfer belt member. Therefore, the transfer member is vibrated by the movement of the image carrier and the belt member which are pushed to each other. This vibration causes a fluctuation of the nip pressure. As a result, blur of a transferred image is necessarily caused.

Further, the following problems may be encountered. The electric field is extended from the transfer member to an upstream region located close to the nip portion between the latent image carrier and the transfer belt member. By the action of this extended electric field, the toner is scattered, which causes blur of a transferred image. As a result, the image quality is deteriorated.

Furthermore, in the case of a full color image forming apparatus, because quantities of electric charge of toner of a plurality of colors are different from each other, it is difficult to set an optimum transfer voltage.

SUMMARY OF THE INVENTION

The present invention has been accomplished to solve the above problems with the prior art. It is an object of the present invention to provide an image forming apparatus in which the problem of defective transfer caused in a system including an intermediate transfer body, recording medium conveyance member and belt member to be used as a transfer means can be solved so that a transfer image of high image quality can be provided.

In order to accomplish the above object, according to a first aspect of the invention, there is provided an image forming apparatus comprising: a latent image carrier for forming a latent image in accordance with an image signal; a developing unit for developing the latent image with a predetermined toner; a belt member arranged in such a manner that a portion of the belt member comes into contact with the latent image carrier; and a transfer means for transferring a toner image held on the latent image carrier onto the belt member side, the transfer means being arranged on an opposite side to the latent image carrier with respect to the belt member, wherein the transfer means is arranged in the downstream close to a contact region in which the latent image carrier is contacted with the belt member.

According to a second aspect of the intention, there is provided an image forming apparatus according to the first aspect of the invention, in which the transfer means is arranged at a position where the transfer means is contacted with the belt member.

According to a third aspect of the intention, there is provided an image forming apparatus according to the second invention, in which the transfer means is composed of a transfer roller.

According to a fourth aspect of the invention, there is provided an image forming apparatus according to the third invention, in which the belt member is arranged on a tangent shared by the latent image carrier and the transfer means.

Due to the above arrangement the vibration of the transfer means such as a transfer roller can be suppressed, so that the fluctuation of nip pressure can be Suppressed. As a result, no blur is caused on the transferred image. Further, an electric field extending from the transfer means, which is a cause of the occurrence of blur, does not cause blur on the transfer image in the pre-nip portion. Therefore, it is possible to form an image of high image quality.

According to a fifth aspect of the invention, there is provided an image forming apparatus according to the first aspect of the invention, in which the transfer means is arranged at a position where the transfer means is opposed to the belt member while it is not contacted with the belt means.

According to a sixth aspect of the invention, there is provided an image forming apparatus according to the fifth aspect of the invention, in which the transfer means is composed of a transfer roller.

According to a seventh aspect of the invention, there is provided an image forming apparatus according to the fifth aspect of the invention, in which the transfer means is composed of a corotron.

The arrangement according to the fifth to the seventh aspects of the invention can provide the same effect as that of the second to the fourth aspects of the invention described before.

According to an eighth aspect of the invention, there is provided an image forming apparatus according to the first aspect of the invention, in which a contact pressure of the latent image carrier with the belt member is maintained at 10 to 20 g/cm.

According to a ninth aspect of the invention, there is provided an image forming apparatus according to the first aspect of the invention, in which a distance from the center of a contact point of the latent image carrier with the belt member to the center of a contact point of th belt member with the transfer means is determined to be 2 to 4 mm, or alternatively a distance from the center of a contact point of the latent image carrier with the belt member to the center of a non-contact opposing point of the belt member and the transfer means is determined to be 2 to 4 mm According to the arrangement of eighth and the ninth aspects of the invention described above, the occurrence of blur can be prevented, and the nip portion and the transfer means are arranged at the optimum positions to form an image of high image quality.

According to a tenth aspect of the invention, there is provided an image forming apparatus according to the second aspect of the invention, in which a surface of the belt member opposing to the electrostatic latent image carrier is extended by an extending means under the condition that the surface is not contacted with the electrostatic latent image carrier, and the surface is contacted with the electrostatic latent image carrier when the transfer means is pushed against the belt member.

According to the above arrangement, the optimum pressure of the nip formed between the latent image carrier and the belt member can be easily set, and an image of high image quality can be formed.

According to an eleventh aspect of the invention, there is provided an image forming apparatus according to the fifth aspect of the invention, in which a distance from the belt means to the transfer means is determined to be not more than 100 μm.

According to the above arrangement, electric discharge between the belt member and the transfer means is suppressed. Therefore, an image of high quality without blur can be obtained.

According to a twelfth aspect of the invention, there is provided an image forming apparatus according to the seventh aspect of the invention, in which a baffle plate is arranged at a position in the upstream of the belt member movement where the corotron is opposed to the belt member.

According to the above arrangement, he electric field is not extended into a contact start region of the electrostatic latent image carrier and he belt member. Therefore, the occurrence of blur of an image caused by the electric field extending into the pre-nip portion can be avoided, so that an image of high image quality can be provided.

According to a thirteenth aspect of the invention, there is provided an image forming apparatus according to the eleventh aspect of the invention, in which the transfer means is composed of a metallic roller.

When the transfer means is composed of a metallic roller in this arrangement, the accuracy of he metallic roller surface can be enhanced in the process of machining. Therefore, the metallic roller can be accurately set with respect to the belt member.

According to a fourteenth aspect of the invention, there is provided an image forming apparatus according to the thirteenth aspect of the invention, in which a surface of the metallic roller is covered with a resin layer, the electric resistance of which is high.

According to the above arrangement, it is possible to avoid the occurrence of discharge between the metallic roller and the belt member. Therefore, the deterioration of an image caused by a discharge in the transfer section can be suppressed.

According to a fifteenth aspect of the invention, there is provided an image forming apparatus according to the third aspect of the invention, in which the volume resistivity of the transfer means is $10^4$ to $10_9$ Ω·cm.

According to the above arrangement, it is possible to avoid the occurrence of discharge between the roller and the belt member caused by the voltage impressed to form a transfer electric field. Therefore, it is possible to form an image of high image quality.

According to a sixteenth aspect of the invention, there is provided an image forming apparatus comprising: a photoreceptor drum to form a latent image in accordance with an image signal; a color developing unit to develop the latent image with a predetermined color toner; an intermediate transfer belt coming into contact with the photoreceptor drum so that the intermediate transfer belt can be rotated together with the photoreceptor drum, the intermediate transfer belt being capable of transferring a toner image of each color successively formed on the photoreceptor drum so as to form a full color toner image; a secondary transfer roller to simultaneously transfer the full color toner image held on the intermediate transfer belt onto a recording medium; and a primary transfer roller arranged in the downstream close to a contact region of the photoreceptor drum with the intermediate transfer belt, the primary transfer roller being contacted with the intermediate transfer belt to conduct the primary transfer of the toner image on the intermediate transfer belt by forming a transfer electric field between the latent image carrier and the intermediate transfer belt when a voltage, the polarity of which is opposite to the electrical charging polarity of the toner image, is impressed upon a reverse side to the toner image holding surface of the intermediate transfer belt.

In the above arrangement, after the photoreceptor drum has been uniformly charged by a predetermined polarity, a latent image is formed by the scanning of laser beams according to an image signal of a predetermined color.

The color developing apparatus includes a plurality of toner developing units in which a plurality of color toners are accommodated, and a latent image is developed with a predetermined toner.

The intermediate transfer belt is arranged in such a manner that it is rotated while a portion of the intermediate transfer belt comes into contact with the photoreceptor drum which carries a developed toner image on its surface. Toner image of various colors successively formed on the photoreceptor drum are successively transferred onto the photoreceptor drum, so that a full color toner image is carried on the photoreceptor drum.

The secondary transfer roller transfers a full color toner image carried on the intermediate transfer belt onto a recording medium all at once.

The primary transfer roller is arranged at a position in the downstream close to a contact region of the latent image carrier with the intermediate transfer belt. When the primary transfer roller is contacted with a surface of the intermediate transfer belt reverse to the toner image carrying surface and impressed with a voltage, the polarity of which is opposite to the charging polarity of the toner image, a transfer electric field can be formed between the intermediate transfer belt and the primary transfer roller, so that the toner image can be primarily transferred onto the intermediate transfer belt.

Due to the foregoing, vibration of the primary transfer roller can be suppressed when the photoreceptor drum and the intermediate transfer belt are rotated being pushed to each other. Accordingly, fluctuation of the nip pressure can be avoided, and no blur is caused on the transferred image. At the same time, the electric field extending from the transfer means, which is a cause of blur on the transferred image, can be shut off at the pre-nip portion. Therefore, it is possible to form an image of high image quality.

According to a seventeenth aspect of the invention, there is provided an image forming apparatus comprising: a photoreceptor drum to form a latent image in accordance with an image signal; a color developing unit to develop the latent image with a predetermined color toner; an intermediate transfer belt coming into contact with the photoreceptor drum so that the intermediate transfer belt can be rotated together with the photoreceptor drum, the intermediate transfer belt being capable of transferring a toner image of each color successively formed on the photoreceptor drum so as to form a full color toner image; a secondary transfer roller to simultaneously transfer the full color toner image held on the intermediate transfer belt onto a recording medium; and a primary transfer roller arranged in the downstream close to a contact region of the photoreceptor drum with the intermediate transfer belt, the primary transfer roller being not contacted with the intermediate transfer belt to conduct the primary transfer of the toner image on the intermediate transfer belt by forming a transfer electric field between the photoreceptor drum and the intermediate transfer belt when a voltage, the polarity of which is opposite to the electrical charging polarity of the toner image, is impressed upon a reverse side to the toner image holding surface of the intermediate transfer belt.

In the above arrangement, after the photoreceptor drum has been uniformly charged by a predetermined polarity, a latent image is formed by the scanning of laser beams according to an image signal of a predetermined color.

The color developing apparatus includes a plurality of toner developing units in which a plurality of color toners are accommodated, and the latent image is developed with a predetermined toner.

The intermediate transfer belt is arranged in such a manner that it is rotated while a portion of the intermediate transfer belt comes into contact with the photoreceptor drum which carries a developed toner image on its surface. Toner image of various colors successively formed on the photoreceptor drum are successively transferred onto the photoreceptor drum, so that a full color toner image is carried on the photoreceptor drum.

The secondary transfer roller transfers a full color toner image carried on the intermediate transfer belt onto a recording medium all at once.

The primary transfer roller is arranged at a position in the downstream close to a contact region of the latent image carrier with the intermediate transfer belt, and the primary transfer roller is arranged on a reverse surface of the intermediate transfer belt to the toner image carrying surface while the primary transfer roller is not contacted with the intermediate transfer belt. When the primary transfer roller is impressed with a voltage, the polarity of which is opposite to the charging polarity of the toner image, a transfer electric field can be formed between the intermediate transfer belt and the primary transfer roller, so that the toner image can be primarily transferred onto the intermediate transfer belt.

Due to the foregoing, vibration of the primary transfer roller can be suppressed when the photoreceptor drum and the intermediate transfer belt are rotated being pushed to each other. Accordingly, fluctuation of the nip pressure can be avoided, and no blur is caused on the transferred image. At the same time, the electric field extending from the transfer means, which is a cause of blur on the transferred image, can be shut off at the pre-nip portion. Therefore, it is possible to form an image of high image quality.

According to an eighteenth aspect of the invention, there is provided an image forming apparatus comprising: a photoreceptor drum to form a latent image in accordance with an image signal; a color developing unit to develop the latent image with a predetermined color toner; a transfer belt coming into contact with the photoreceptor drum so that the transfer belt can be rotated together with the photoreceptor drum, the transfer belt being capable of conveying a recording medium onto which a predetermined color toner image formed on the photoreceptor drum is transferred; and a transfer roller arranged in the downstream close to a contact region of the photoreceptor drum with the transfer belt, the transfer roller being contacted with the transfer belt to form a transfer electric field between the photoreceptor drum and the transfer belt when a voltage, the polarity of which is opposite to the electrical charging polarity of the toner image, is impressed upon a reverse side to a recording medium holding surface of the transfer belt.

In the above arrangement, after the photoreceptor drum has been uniformly charged by a predetermined polarity, a latent image is formed by the scanning of laser beams according to an image signal of a predetermined color.

The color developing apparatus includes a plurality of toner developing units in which a plurality of color toners are accommodated, and the latent image is developed with a predetermined toner.

The transfer belt is arranged in such a manner that a portion of the transfer belt is contacted with the photoreceptor belt and rotated, so that a recording medium onto which the predetermined toner image formed on the photoreceptor drum is transferred is conveyed by the transfer belt.

The transfer roller is arranged at a position in the downstream close to a contact region of the photoreceptor drum with the transfer belt. When the transfer roller is contacted with a surface of the transfer belt reverse to the recording medium carrying surface and impressed with a voltage, the polarity of which is opposite to the charging polarity of the toner image, a transfer electric field can be formed between the transfer belt and the primary transfer roller.

Due to the foregoing, vibration of the transfer roller can be suppressed when the photoreceptor drum and the transfer belt are rotated being pushed to each other. Accordingly, fluctuation of the nip pressure can be avoided, and no blur is caused on the transferred image. At the same time, an electric field extending from the transfer means, which is a cause of blur on the transferred image, can be shut off at the pre-nip portion. Therefore, it is possible to form an image of high image quality.

According to a nineteenth aspect of the invention, there is provided an image forming apparatus comprising: a photoreceptor drum to form a latent image in accordance with an image signal; a color developing unit to develop the latent image with a predetermined color toner; a transfer belt coming into contact with the photoreceptor drum so that the transfer belt can be rotated together with the photoreceptor drum, the transfer belt being capable of conveying a recording medium onto which a predetermined color toner image formed on the photoreceptor drum is transferred; and a transfer roller arranged in the downstream close to a contact region of the photoreceptor drum with the transfer belt, the transfer roller being not contacted with the transfer belt to form a transfer electric field between the photoreceptor drum and the transfer belt when a voltage, the polarity of which is opposite to the electrical charging polarity of the toner image, is impressed upon a reverse side to a recording medium holding surface of the transfer belt.

In the above arrangement, after the photoreceptor drum has been uniformly charged by a predetermined polarity, a latent image is formed by the scanning of laser beams according to an image signal of a predetermined color.

The color developing apparatus includes a plurality of toner developing units in which a plurality of color toners are accommodated, and the latent image is developed with a predetermined toner.

The transfer belt is arranged in such a manner that a portion of the transfer belt is contacted with the photoreceptor drum and rotated, so that the transfer belt conveys a recording medium onto which the predetermined toner image formed on the photoreceptor drum is transferred.

The transfer roller is arranged at a position in the downstream close to a contact region of the photoreceptor drum with the transfer belt, and the transfer roller is arranged on a reverse surface of the transfer belt to the recording medium carrying surface while the transfer roller is not contacted with the transfer belt. When the transfer roller is impressed with a voltage, the polarity of which is opposite to the charging polarity of the toner image, a transfer electric field can be formed between the photoreceptor drum and the transfer roller.

Due to the foregoing, vibration of the transfer roller can be suppressed when the photoreceptor drum and the transfer belt are rotated being pushed to each other. Accordingly, fluctuation of the nip pressure can be avoided, and no blur is caused on the transferred image. At the same time, the electric field extending from the transfer means, which is a cause of blur on the transferred image, can be shut off at the pre-nip portion. Therefore, it is possible to form an image of high image quality.

According to a twentieth aspect of the invention, there is provided an image forming apparatus comprising: a plurality of photoreceptor drums respectively forming a latent image in accordance with each image signal of a plurality of color images; a plurality of color developing units respectively provided to the plurality of photoreceptor drums so as to develop each latent image with a predetermined color toner; a transfer belt coming into contact with each photoreceptor drum so that the transfer belt can be rotated together with the photoreceptor drum, the transfer belt being capable of conveying a recording medium onto which each color toner image formed on each photoreceptor drum is successively transferred; and a plurality of transfer rollers arranged in the downstream close to a contact region of the photoreceptor drum with the transfer belt, the transfer rollers being contacted with the transfer belt to form a transfer electric field between the photoreceptor drum and the transfer belt when a voltage, the polarity of which is opposite to the electrical charging polarity of the toner image, is impressed upon a reverse side to a recording medium holding surface of the transfer belt.

In the above arrangement, each of the plurality of photoreceptor drums forms a latent image corresponding to an image signal of each color.

The plurality of color developing units are respectively provided around the plurality of photoreceptor drums, and each color developing unit develops each latent image with a predetermined color toner.

The transfer belt is arranged in such a manner that a portion of the transfer belt is contacted with the photoreceptor drum and rotated, and the transfer belt conveys each color toner image formed on each photoreceptor drum so that the color toner image can be successively superimposed.

The plurality of transfer rollers are arranged at positions in the downstream close to each contact region of the photoreceptor drum with the transfer belt, and each transfer roller is arranged on a reverse surface of the transfer belt to the recording medium carrying surface while the transfer roller is contacted with the transfer belt. When the transfer roller is impressed with a voltage, the polarity of which is opposite to the charging polarity of the toner image, a transfer electric field can be formed between the photoreceptor drum and the transfer roller.

Due to the foregoing, vibration of the transfer roller can be suppressed when the photoreceptor drum and the transfer belt are rotated being pushed to each other. Accordingly, fluctuation of the nip pressure can be avoided, and no blur is caused on the transferred image. At the same time, the electric field extending from the transfer means, which is a cause of blur on the transferred image, can be shut off at each pre-nip portion. Therefore, it is possible to form an image of high image quality.

According to a twenty-first aspect of the invention, there is provided an image forming apparatus comprising: a plurality of photoreceptor drums respectively forming a latent image in accordance with each image signal of a plurality of color images; a plurality of color developing units respectively provided to the plurality of photoreceptor drums so as to develop each latent image with a predetermined color toner; a transfer belt coming into contact with each photoreceptor drum so that the transfer belt can be rotated together with the photoreceptor drum, the transfer belt being capable of conveying a recording medium onto which each color toner image formed on each photoreceptor drum is successively transferred; and a plurality of transfer rollers arranged in the downstream close to a contact region of the photoreceptor drum with the transfer belt, the transfer rollers being not contacted with the transfer belt to form a transfer electric field between the photoreceptor drum and the transfer belt when a voltage, the polarity of which is opposite to the electrical charging polarity of the toner image, is impressed upon a reverse side to a recording medium holding surface of the transfer belt.

In the above arrangement, each of the plurality of photoreceptor drums forms a latent image corresponding to an image signal of each color.

The plurality of color developing units are respectively provided around the plurality of photoreceptor drums, and each color developing unit develops each latent image with a predetermined color toner.

The transfer belt is arranged in such a manner that a portion of the transfer belt is contacted with the photoreceptor drum and rotated, and the transfer belt conveys each color toner image formed on each photoreceptor drum so that the color toner image can be successively superimposed.

The plurality of transfer rollers are arranged at positions in the downstream close to each contact region of the photoreceptor drum with the transfer belt, and each transfer roller is arranged on a reverse surface of the transfer belt to the recording medium carrying surface while the transfer roller is not contacted with the transfer belt. When the transfer roller is impressed with a voltage, the polarity of which is opposite to the charging polarity of the toner image, a transfer electric field can be formed between the photoreceptor drum and the transfer roller.

Due to the foregoing, vibration of the transfer roller can be suppressed when the photoreceptor drum and the transfer belt are rotated being pushed to each other. Accordingly, fluctuation of the nip pressure can be avoided, and no blur is caused on the transferred image. At the same time, the electric field extending from the transfer means, which is a cause of blur on the transferred image, can be shut off at each pre-nip portion. Therefore, it is possible to form an image of high image quality.

In this connection, the photoreceptor drum is used in the above sixteenth to the twenty-first invention as a latent image carrier. In general, this photoreceptor drum is a drumshaped member covered with a photosensitive material on which an electrostatic latent image is formed by the scanning of rays of light such as laser beams. However, it should be noted that the latent image carrier is not limited to the above specific embodiment. It is possible to use a latent image carrier on which a latent image is formed by the action of a magnetic head or an ion head.

Concerning the belt member in either of the above inventions, in general, the belt member is made up of an endless belt member which are trained round a plurality of rollers. However, the present invention is not limited to the above specific embodiment. The belt member may be supported in the manner of a drum-shape.

In the color image forming apparatus according to the twentieth and the twenty-first aspects of the invention described above, toner images of a plurality of colors respectively carried by a plurality of latent image carriers (photoreceptor drums) are successively transferred in accordance with the conveyance of the transfer belt onto a recording medium such as a sheet of transfer paper which is placed on and conveyed by the transfer belt. In the above color image forming apparatus, the transfer means in the transfer section of all photoreceptor drums are arranged in the downstream of the nip portion. However, it should be noted that the present invention is not limited to the above specific embodiment. Only one, two or three of the transfer means may be arranged in the downstream of the nip portion or alternatively the transfer member (transfer roller or corotron) in the nip portion of the final transfer portion, the transfer electric field of which is high, may be arranged in the downstream of the nip portion.

According to the present invention, the transfer roller to transfer a toner image carried by the latent image carrier is arranged in the downstream of the contact portion (nip portion) of the latent image carrier with the transfer body such as an intermediate transfer belt. Accordingly, a quantity of peeling discharge is increased in a region where the transfer body is separated from the latent image carrier. As a result, a quantity of electric charge of the toner image to be transferred at the end, which is smallest among the plurality of toner images that have been transferred, is increased. Therefore, it is possible to prevent the occurrence of secondary transfer onto the recording medium, and also it is possible to prevent the occurrence of defective transfer when the toner image is directly transferred onto the recording medium.

Length of the contact region of the latent image carrier with the intermediate transfer body, or length of the contact region of the latent image carrier with the transfer belt is short. Therefore, the nip pressure is not increased in the nip portion. Consequently, it is possible to avoid the occurrence of defective transfer such as whitening.

The above and other objects and features of the present invention will be more apparent from the following description taken in conjunction with the accompanying drawings.

DETAILED DESCRIPTION OF THE PREFERRED EMBODIMENTS

Referring to an embodiment, the present invention will be explained below in detail.

Figure 1:
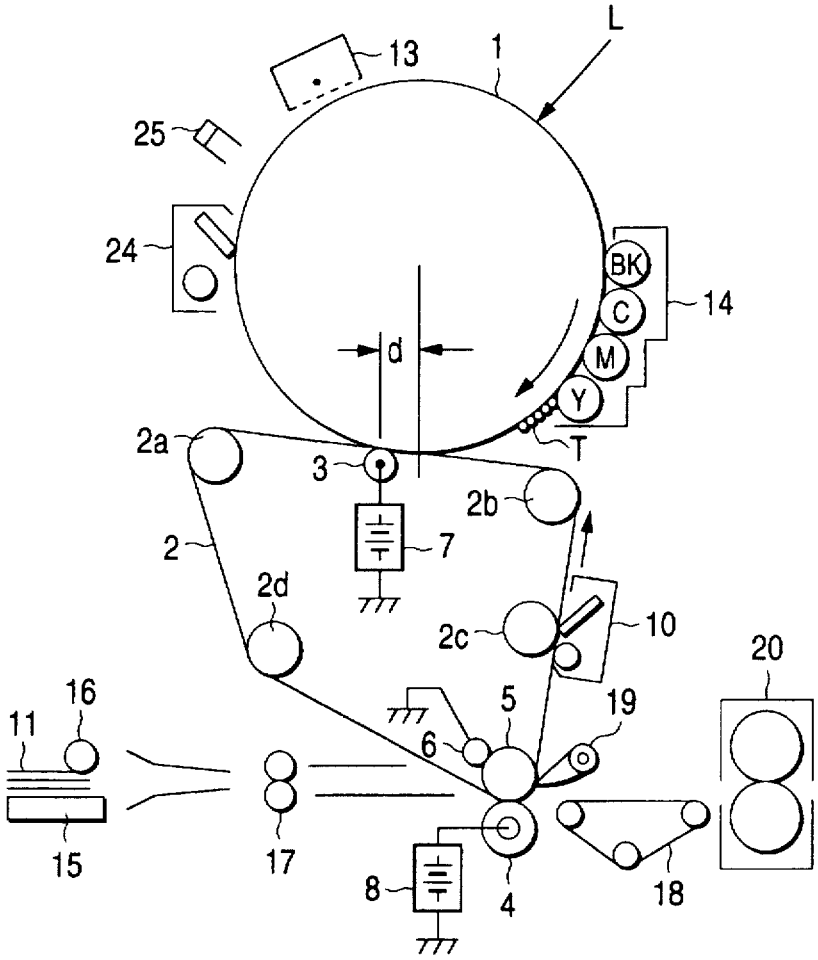
FIG. 1 is a view showing an example of the color image forming apparatus of the present invention in which a contact transfer member (transfer roller) and a belt-shaped intermediate transfer body are used.
Figure 18:
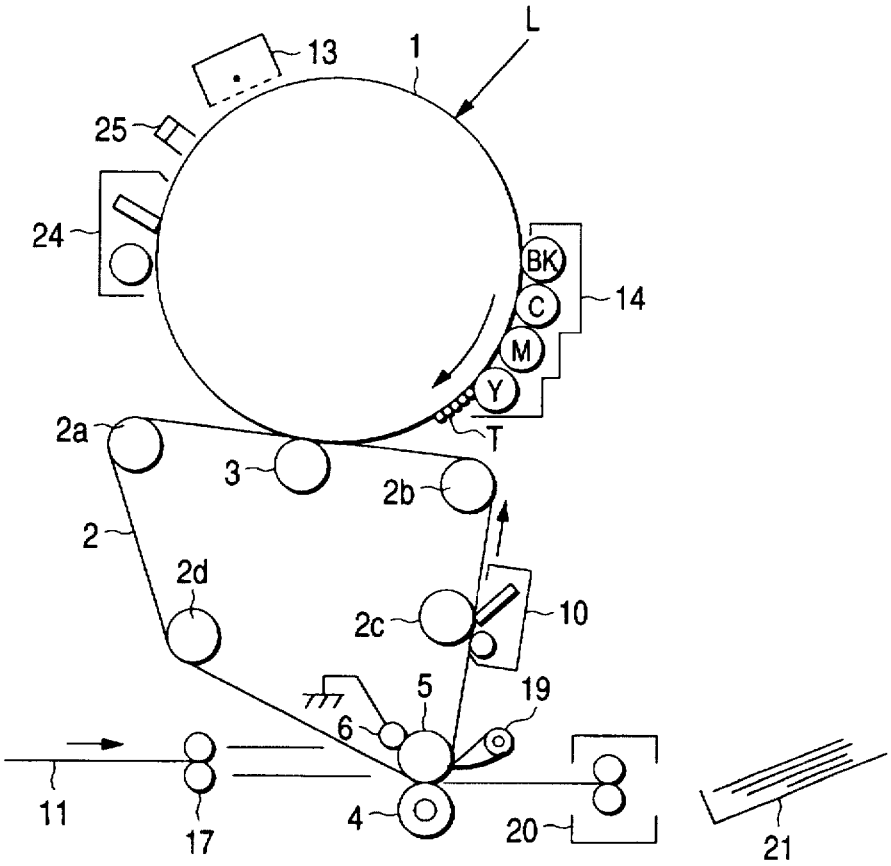
FIG. 18 is a schematic illustration to explain a general construction of the principal portion of a color printer which is an example of the image forming apparatus using a belt-shaped intermediate transfer body.
Figure 19:
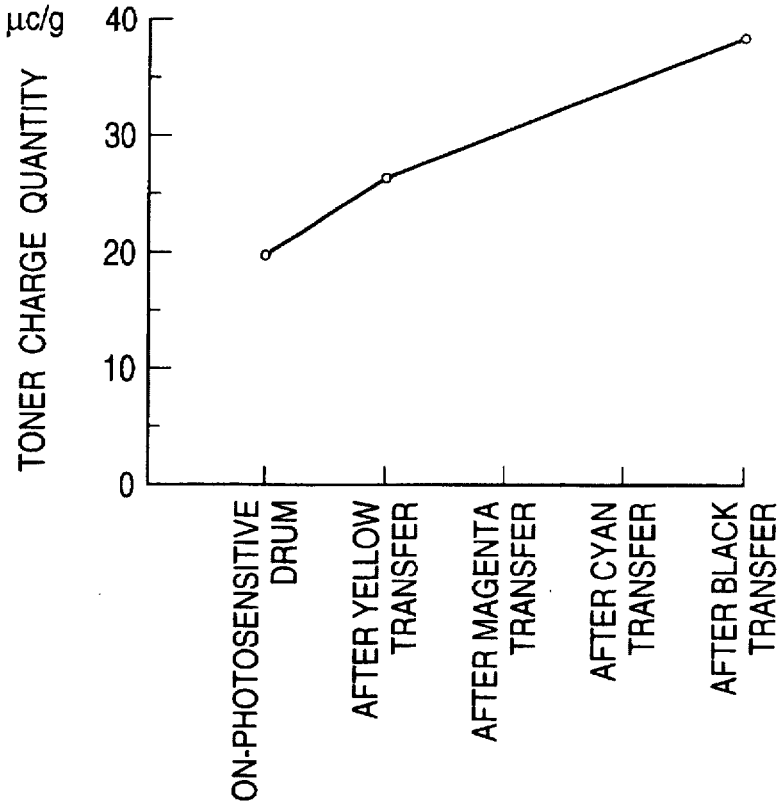
FIG. 19 is a schematic illustration to explain a change in the quantity of electric charge of a toner image of the first color (yellow) in the primary transfer cycle conducted on the intermediate transfer belt.
Figure 20:
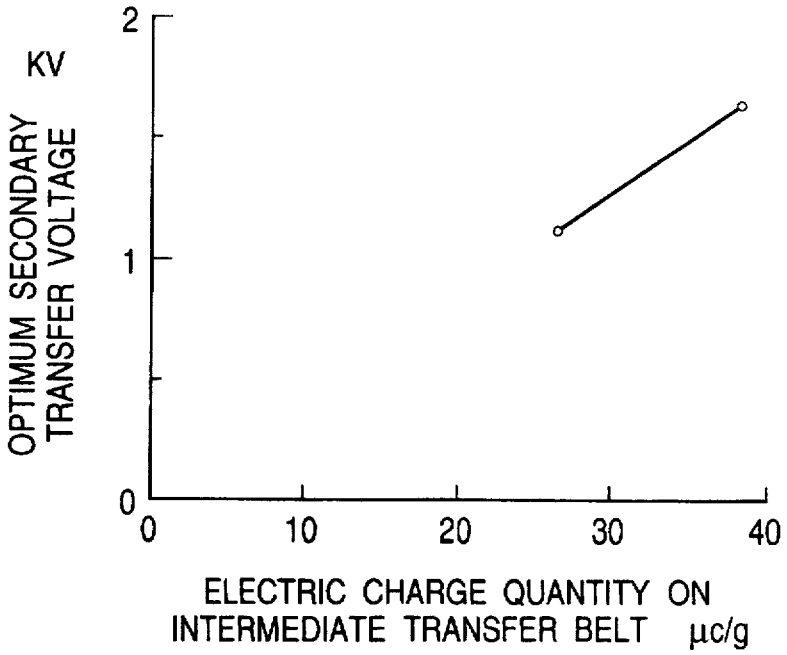
FIG. 20 is a schematic illustration to explain a relation between the quantity of electric charge of toner on the intermediate transfer belt and the optimum secondary transfer voltage.
Figure 21:
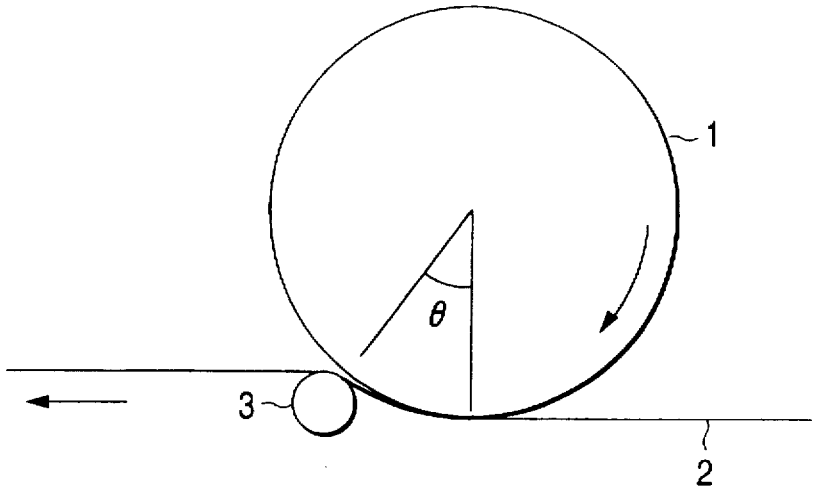
FIG. 21 is a schematic illustration showing a positional relation among the photoreceptor drum, intermediate transfer belt and primary transfer roller in the primary transfer section disclosed in the prior art.
Figure 22:
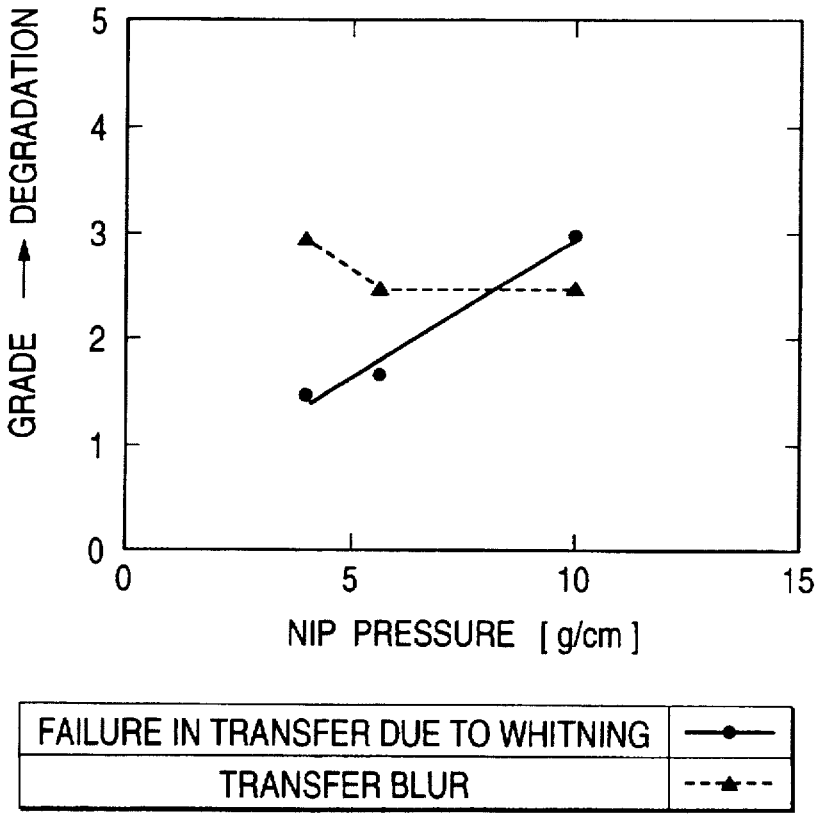
FIG. 22 is a schematic illustration to explain a relation between the transfer image quality and the nip pressure generated between the intermediate transfer belt and the photoreceptor drum.

FIG. 1 is a schematic illustration for explaining the general construction of a color printer which is a first embodiment of the color image forming apparatus of the present invention comprising a belt-shaped intermediate transfer body. Like reference characters are used to indicate like parts in FIG. 1 and FIG. 18 explained before. Reference numeral 6 is a contact roller, reference numeral 7 is a primary transfer power source, reference numeral 8 is a secondary transfer power source, reference numeral 15 is a tray, reference numeral 16 is a pickup roller, and reference numeral 17 is a register roller.

In the drawing, a surface of the photoreceptor drum 1 is uniformly charged with electric charge having a predetermined polarity. When the writing scanning is conducted by laser beams L modulated by the image signal of the first color, an electrostatic latent image according to the first color (for example, yellow) is formed.

When the photoreceptor drum 1 is rotated by one revolution, this electrostatic latent image is conveyed to a position at which the developing apparatus 14 is arranged. Then, the electrostatic latent image is developed by the developing unit with the toner of the first color, and the photoreceptor drum, on the surface of which the developed toner image is carried, is further rotated.

In accordance with the toner developing motion described above, the intermediate transfer belt 2 is moved at the substantially same circumferential speed as that of the photoreceptor drum 1. In the primary transfer section in which the photoreceptor drum 1 comes into contact with the intermediate transfer belt 2, the toner image carried by the photoreceptor drum 1 is primarily transferred onto the intermediate transfer belt 2 by the action of a transfer electric field, the polarity of which is reverse to the charging polarity of toner, impressed upon the primary transfer roller 3 by the primary transfer power source 7. This transfer cycle is referred to as a first transfer cycle.

The primary transfer roller 3 is arranged at a position in the downstream of the intermediate transfer belt 2 which is distant from the contact portion (nip portion) of the photoreceptor drum 1 with the intermediate transfer belt 2 by a distance "d" (2 to 4 mm), wherein the primary transfer roller 3 only comes into contact with the intermediate transfer belt 2 at this position. Pressure in this nip portion, that is, the nip pressure is set at 10 to 20 g/cm.

The toner image which has been primarily transferred onto the intermediate transfer belt 2 is conveyed to the secondary transfer section, in which the secondary transfer roller 4 is arranged, when the intermediate transfer belt 2 is rotated.

In the case of a full color copier, a color toner image is formed when the operation , which includes formation of a latent image on the photoreceptor drum, development of the latent image conducted by toner and primary transfer of the toner image, is repeated by the frequency corresponding to the number of predetermined colors (yellow: Y, cyan: C, magenta: M and black: BK) so that multi-color toner images can be superimposed on the intermediate transfer belt 2.

In general, the developing apparatus 14 arranged in the color image forming apparatus includes a Bk developing unit, cyan developing unit, magenta developing unit and yellow developing unit, that is, the developing apparatus 14 is composed of the developing units of 4 colors. The developing unit of each toner color is selectively positioned at a developing position so that the latent image of each color formed on the photoreceptor drum 1 can be successively developed, or alternatively the developing positions are successively arranged around the photoreceptor drum 1.

After the toner image of the first color carried on the photoreceptor drum 1 has been transferred onto the intermediate transfer belt 2 at the position of the primary transfer unit 3, the residual toner on the photoreceptor drum 1 is removed by the latent image carrier cleaner 24, and the residual electric charge on the photoreceptor drum 1 is neutralized by the discharger 25. After that, the latent image of the second color is formed.

The latent image of the second color (for example, magenta) is developed in the same manner as that of the first color. The toner image of the second color is transferred and superimposed on the toner image of the first color which has previously been transferred onto the intermediate transfer belt 2.

The toner images of the third color (cyan) and the fourth color (black) are transferred onto the intermediate transfer belt 2 in the same manner. As a result, on the intermediate transfer belt 2, there is formed a color toner image on which toner images of a plurality of colors, which have not been fixed yet, are superimposed. This transfer cycle is referred to as a secondary transfer cycle.

In this connection, the secondary transfer roller 4, intermediate transfer body cleaner 10 and separation claw are withdrawn from the intermediate transfer belt 2 until the transfer of the final toner image is completed.

At a point of time when the intermediate transfer belt 2 onto which all necessary color toner images have been primarily transferred is conveyed to the secondary transfer roller 4, the recording medium 11, which has been sent out from the tray 15 by the register roller 17 in timed relation with the transfer of the toner image, is fed between the intermediate transfer belt 2 and the secondary transfer roller 4.

When the recording medium 11 is conveyed by the secondary transfer roller 4, intermediate transfer belt 2 and backup roller 5, the toner image on the intermediate transfer belt 2 is secondarily transferred onto the recording medium 11 by the action of the transfer electric field formed by the transfer voltage, the polarity of which is reverse to the charging polarity of the toner image, impressed upon between the secondary transfer roller 4 and the intermediate transfer belt 2 by the secondary transfer power source 8.

The recording medium 11 onto which the toner image has been secondarily transferred is separated from the intermediate transfer belt 2 by the separation claw 19 and sent to the fixing unit 20 by the recording medium conveyance belt 18. By the fixing unit 20, the toner image is fixed when the recording medium 11 is made to pass between a pair of fixing rollers and heated. Then the recording medium 11 is delivered onto a delivery tray not shown in the drawing. In this way, the image formation process is completed.

When the intermediate transfer belt 2 passes through the intermediate transfer body cleaner 10 after the completion of secondary transfer, the residual toner on the intermediate transfer belt 2 is removed so as to prepare for the next image formation process.

Figure 2:
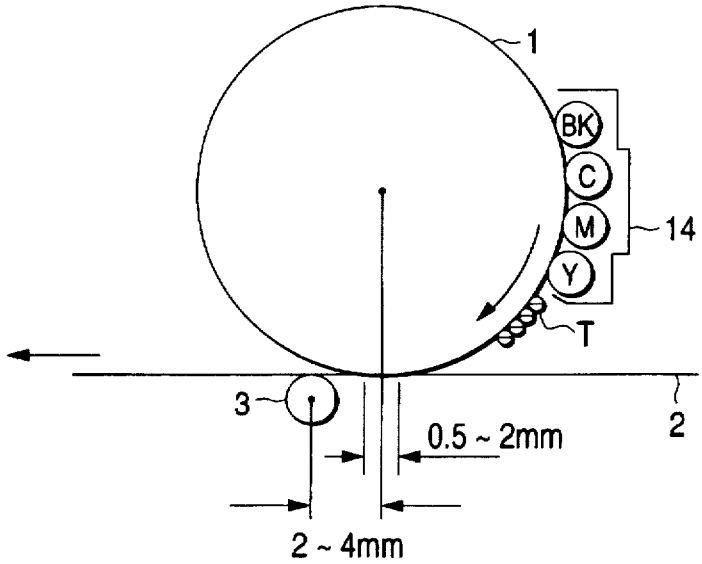
FIG. 2 is a schematic illustration showing a primary transfer portion including a contact transfer member (transfer roller)

FIG. 2 is a schematic illustration showing a principal portion of the primary transfer section of the color image forming apparatus of the present invention in which the belt-shaped intermediate transfer body is used. Like reference characters are used to indicate like parts in FIGS. 1 and 2.

In the drawing, a toner image T, which has been electrically charged to the negative polarity, is formed on the surface of the photoreceptor drum 1 by the developing apparatus 14.

The intermediate transfer belt 2 is made of polyimide resin. That is, the intermediate transfer belt 2 is a sheet of semiconductive resin film, the thickness of which is 60 to 90 μm, the volume resistivity of which is $10^9$ to $10^{12}$ Ω·cm, and the surface resistivity of which is $10^{11}$ to $10^{13}$ Ω/?.

Any semiconductive resin material, the thickness, volume resistivity and surface resistivity of which are in the above ranges, may be applied to this intermediate transfer belt 2. Further, it is possible to use acrylic resin, vinyl chloride resin, polyester resin or polycarbonate resin to which resistance stabilization material is added.

In other words, the intermediate transfer belt 2 in the primary transfer section is arranged on a tangent on the surface of the photoreceptor belt 2. Therefore, the contact force of the intermediate transfer belt 2 with the photoreceptor drum 1 is approximately zero when the intermediate transfer belt is set in the apparatus. Even if the intermediate transfer belt 2 overlaps with the photoreceptor a little, the contact pressure is extremely increased.

The contact pressure of the photoreceptor drum 1 with the intermediate transfer roller 2 in the primary transfer section can be obtained when the primary transfer roller 3 is pushed upward in the drawing by a spring not shown in the drawing.

In this case, the contact pressure is preferably set at 10 to 20 g/cm. When the contact pressure is higher than 10 to 20 g/cm, a transfer failure of whitening occurs. When the contact pressure is lower than 10 to 20 g/cm, it is impossible to conduct transferring uniformly.

Accordingly, the contact width (nip width) of the intermediate transfer belt 2 with the photoreceptor drum 1 is 0.5 to 2 mm.

The primary transfer roller 3 is arranged at a position in the downstream of the contact portion of the photoreceptor drum 1 with the intermediate transfer belt 2, wherein a distance from the center of the contact portion to the primary transfer roller 3 is 2 to 4 mm.

Transfer operation is conducted when a transfer current flows from the primary transfer roller 3 to the semiconductive intermediate transfer belt 2 and further flows into the contact region of the photoreceptor drum 1 with the intermediate transfer belt 2.

In order to transfer a toner image, which has been charged to the negative polarity, formed on the photoreceptor drum 1, a positive voltage is impressed upon the primary transfer roller 3. Due to the fluctuation of the resistance of the primary transfer roller 3 and the resistance of the intermediate transfer belt 2, and also due to the fluctuation of toner charging, it is preferable to adopt a constant current control system for controlling the transfer electric field. In this embodiment, it was possible to obtain an excellent transfer property when the transfer current was controlled in a range from 15 to 25 μA.

It was preferable to maintain the volume resistivity of the primary transfer roller 3 in a range from $10^4$ to $10^9\Omega\cdot$cm. The primary transfer roller 3 was made of sponge-like foaming elastic silicon rubber, the hardness of which was 25° to 45° (measured by Asuka C Scale).

In this connection, EPDM and polyurethane may be used for the primary transfer roller 3 as long as the material satisfies the physical values described above.

Concerning the size of each component in this embodiment, the diameter of the primary transfer roller 3 was 20 mm, and the diameter of the photoreceptor drum 1 was 84 mm.

After the primary transfer has been conducted in the above arrangement, it is possible to obtain an image of high quality when a voltage to be impressed upon the secondary transfer roller 3 in the secondary transfer process is set at a value higher than the primary transfer voltage by 1.6 KV.

The reason why it is possible to obtain an image of high quality is that a quantity of electric charge of each toner image formed on the intermediate transfer belt 2 is stable with respect to all colors from the first color of yellow to the final color of black.

The reason of stabilization of the quantity of electric charge is further described as follows. In the primary transfer section, the transfer electric field region in a portion where the intermediate transfer belt is separated from the photoreceptor drum is arranged from the primary transfer roller to the contact portion of the photoreceptor drum with the intermediate transfer belt. In the above separating section, an intensity of the separating electric field is increased. Therefore, a quantity of electric charge of the toner image on the intermediate transfer belt is increased by the separating discharge, so that it can be stabilized.

When a distance from the primary transfer roller 3 to the intermediate transfer belt 2 is not more than 100 μm, it is possible to obtain an excellent transfer property even if both are not contacted with each other.

Figure 3:
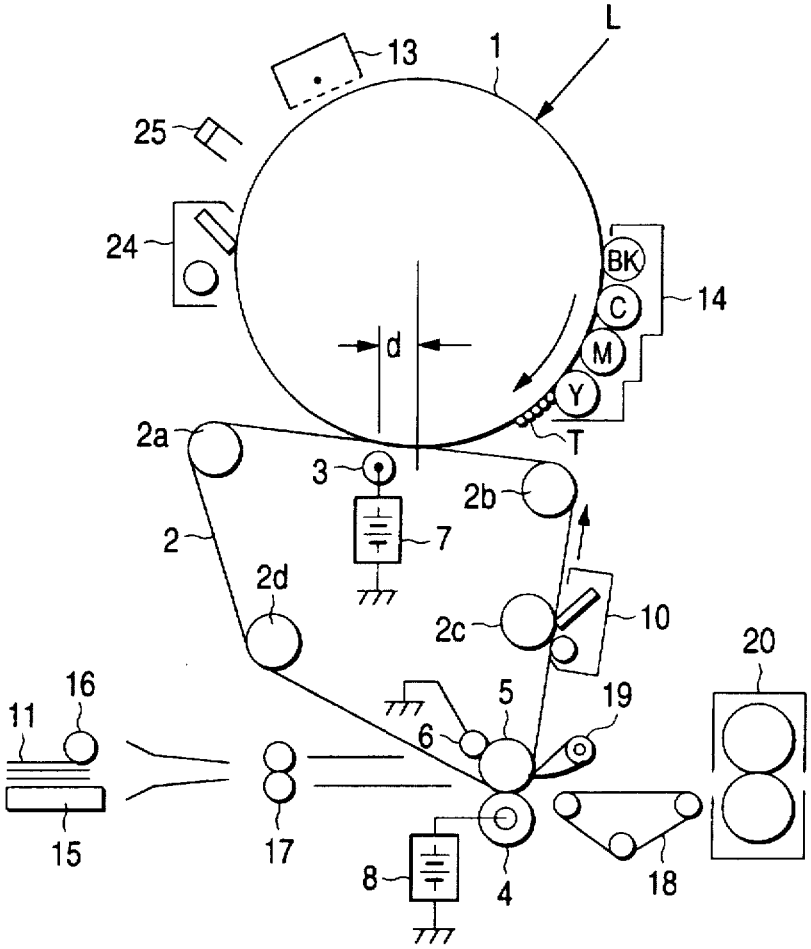
FIG. 3 is a schematic illustration showing an example of the transfer portion of the present invention including a non-contact transfer member (transfer roller)
Figure 4:
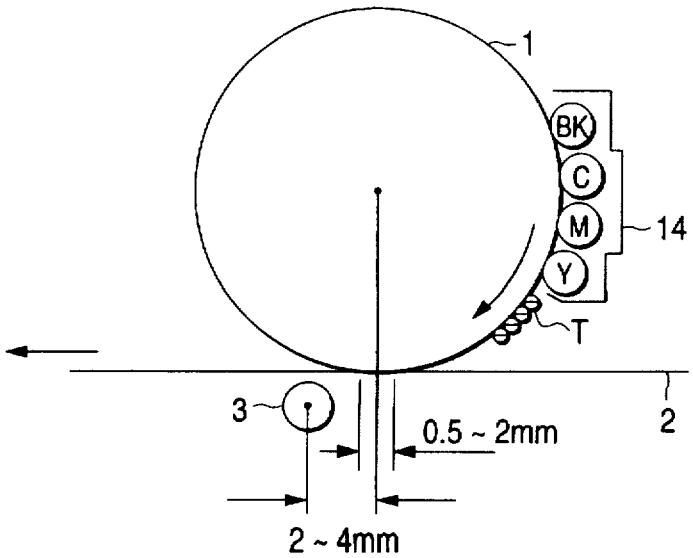
FIG. 4 is a schematic illustration showing a primary transfer portion including a non-contact transfer member (transfer roller)

FIG. 3 is a schematic illustration showing a principal portion of the color printer which is the second embodiment of the color image forming apparatus of the present invention in which the belt-shaped intermediate transfer body is used. Fig. 4 is a schematic illustration showing the detail of the primary transfer portion of the second embodiment. Like reference characters are used to indicate like parts in FIGS. 1, 3 and 4.

In this embodiment, the primary transfer roller 3 is arranged not coming into contact with a reverse side of the intermediate transfer belt 2. Except for that, the arrangements of other components are the same as those shown in FIG. 1.

In this embodiment, the primary transfer roller 3 is arranged in the downstream of the nip portion not coming into contact with the intermediate transfer belt 2, wherein a distance from the nip center to the primary transfer roller 3 is 2 to 4 mm and a distance from the intermediate transfer belt 2 to the primary transfer roller 3 is not more than 100 μm.

In this case, constant current control is conducted on the primary transfer roller 3, and the current is controlled to be in a range from 15 to 25 μA.

In this embodiment, it is possible to form an image of high quality in the same manner as that of the first embodiment described before.

Figure 5:
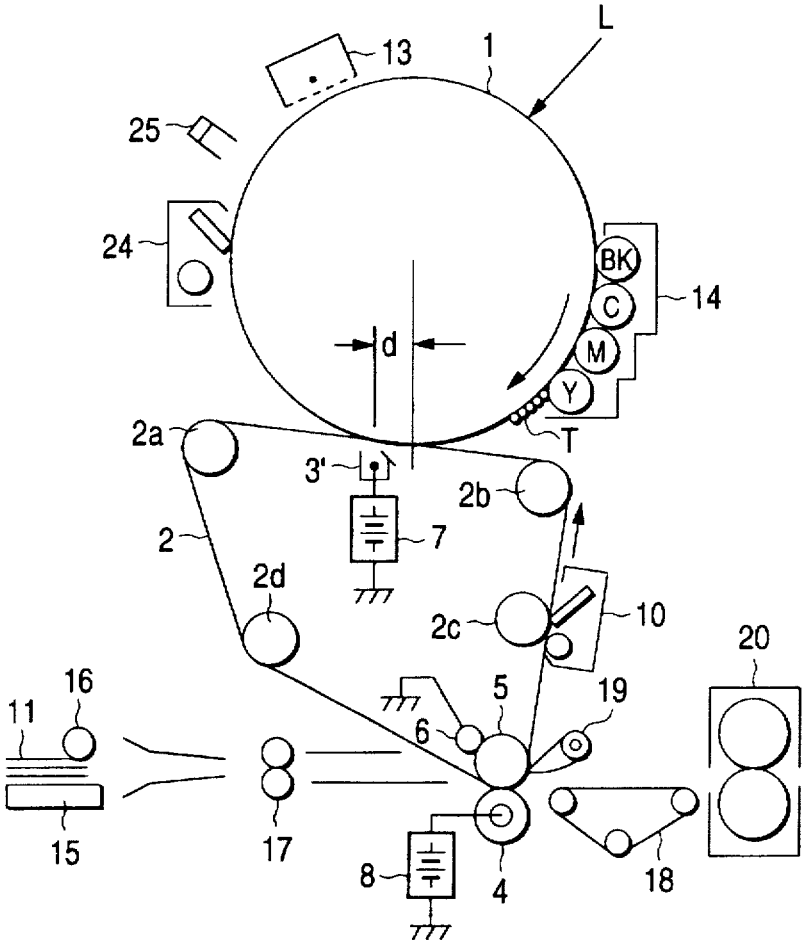
FIG. 5 is a schematic illustration showing an example of the transfer portion of the present invention including a non-contact transfer member (corotron)
Figure 6:
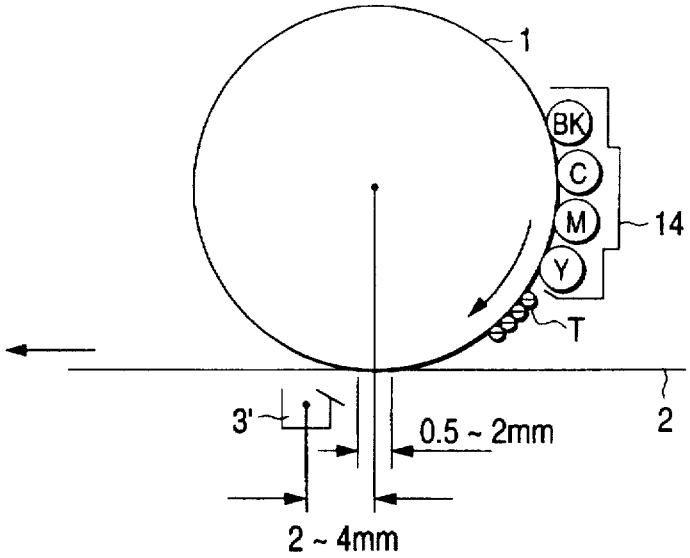
FIG. 6 is a schematic illustration showing a primary transfer portion including a non-contact transfer member (corotron)

FIG. 5 is a schematic illustration showing a principal portion of the color printer which is the third embodiment of the color image forming apparatus of the present invention in which the belt-shaped intermediate transfer body is used. FIG. 6 is a schematic illustration showing the detail of the primary transfer portion of the third embodiment. Like reference characters are used to indicate like parts in FIGS. 3, 5 and 6.

In this embodiment, the corotron 3', which is a primary transfer means, is arranged on a reverse side of the intermediate transfer belt 2 while the corotron 3' is not contacted with the surface of the intermediate transfer belt 2. A baffle plate **3*a* is disposed upstream of the corotron 3, to prevent an electric field from extending into a contact start region of the electrostatic latent image carrier with the belt member. Except for that, the arrangements of other components are the same as those shown in FIG. 3**.

In this embodiment, the corotron 3' is arranged in the downstream of the nip portion not coming into contact with the intermediate transfer belt 2, wherein a distance from the nip center to the corotron 3' is 2 to 4 mm and the corotron 3' is not contacted with the intermediate transfer belt 2.

In this embodiment, it is possible to form an image of high quality in the same manner as that of the first embodiment described before.

Figure 7:
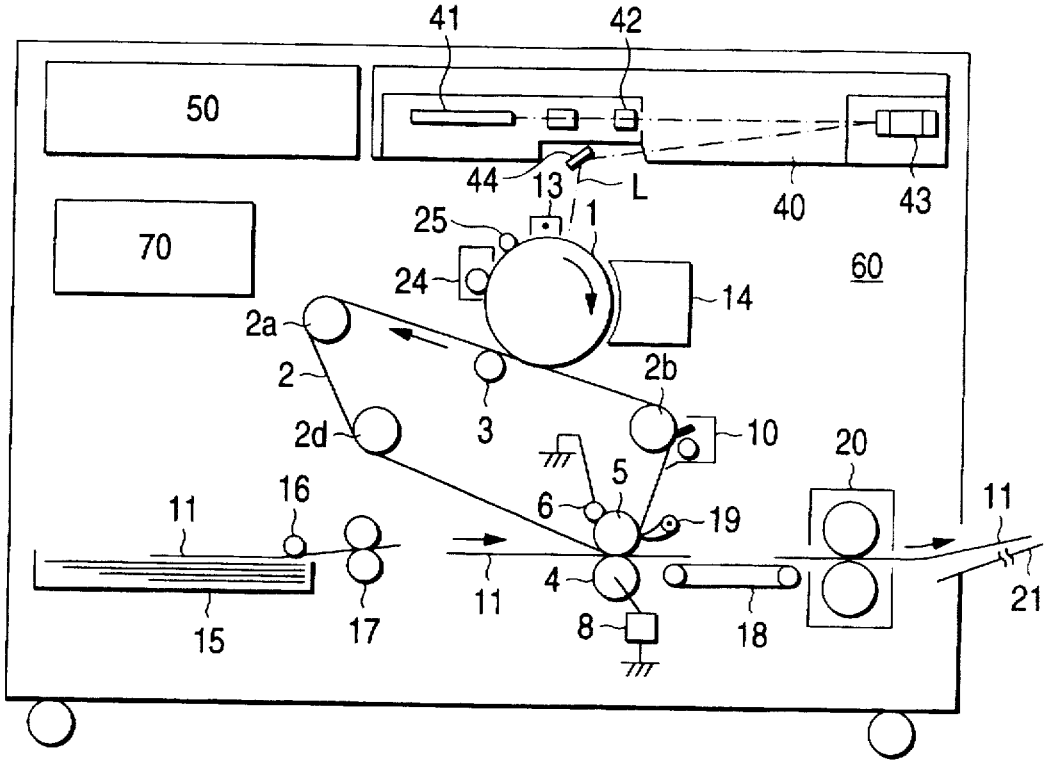
FIG. 7 is a schematic illustration showing the color image forming apparatus of the present invention in which a belt-shaped intermediate transfer body is used.

FIG. 7 is a schematic illustration showing an overall arrangement of the color image forming apparatus of the present invention. This arrangement is the same as that shown in FIG. 1 in which the belt-shaped intermediate transfer body is used. In this connection, the overall arrangement of the image forming apparatus corresponding to the third and fourth embodiment is the same as that of this embodiment except for the structure of the primary transfer means.

In this drawing, reference numeral 40 is a laser beam writing section, reference numeral 50 is an image signal processing section, reference numeral 60 is an image forming section, and reference numeral 70 is an image forming control section.

The laser beam writing section 40 includes: a laser 41, image forming optical system 42, scanning optical system 43, and mirror 44. The laser 41 emits a laser beam L modulated by an image signal of each color which has been variously processed in the image signal processing section 50.

The image forming section 60 includes: a photoreceptor drum 1, intermediate transfer belt 2, primary transfer roller 3, and secondary transfer roller 4. Around the photoreceptor drum, there are provided a latent image carrier charger (corotron) 13, color developing apparatus, latent image carrier cleaner 24, and discharger 25. The intermediate transfer belt 2 is conveyed while it is trained round the drive roller **2*a*, idle roller 2*b*, tension roller 2*d* and backup roller 5**.

The contact roller 6 is arranged coming into contact with the backup roller 5. Due to the above arrangement, there is formed a transfer electric current path including the transfer power supply 8, secondary transfer roller 4, lamination body of the recording medium 11 and the intermediate transfer belt 2, backup roller 5, contact roller 6, and ground.

After the final color toner image composing the color image has been primarily transferred from the photoreceptor drum 1 onto the intermediate transfer belt 2, the intermediate transfer belt 2 is conveyed to the secondary transfer section in which the intermediate transfer belt 2 and the secondary transfer roller 4 are arranged.

On the other hand, one sheet of recording medium 11 is picked up from the tray 15 by the pickup roller 16. This recording medium 11 waits for the successive operation at the register roller 17 and advances to a nip portion formed by the secondary transfer roller 4 and the intermediate transfer belt 2 in timed relation with a multicolor toner image carried on the intermediate transfer belt 2 which advances to the nip portion.

In the secondary transfer section, a transfer current flows in the above transfer current path when the secondary transfer voltage is impressed upon the secondary transfer section by the transfer power supply 8. Therefore, the multicolor toner image carried on the intermediate transfer belt 2 is simultaneously transferred onto the recording medium 11.

The recording medium 11 onto which the multicolor toner image has been transferred is separated from the intermediate transfer belt 2 by the separation claw 19, and conveyed to the fixing unit 20 by the recording medium conveyance belt 18. In the fixing unit 20, the multicolor image on the recording medium is fixed, and then the recording medium 11 is delivered onto the delivery tray 21.

After the toner image has been transferred onto the recording medium 11, residual toner on the intermediate transfer belt 2 is removed by the intermediate transfer body cleaner 10. In this way, the intermediate transfer belt 2 is ready for the next transfer operation.

Due to the above operation, the multicolor toner image transferred onto the intermediate transfer belt can be transferred onto the recording medium in a good condition, so that a color image of high image quality can be provided.

Since the contact region in which the photoreceptor drum and the intermediate transfer belt are contacted with each other is maintained to be short, the nip pressure is not increased. Accordingly, no transfer failure of whitening occurs.

In the same manner as that of the embodiment described before, vibration of the transfer roller is suppressed, and the occurrence of blur in the pre-nip portion can be prevented. Therefore, it is possible to form an image of high image quality.

Figure 8:
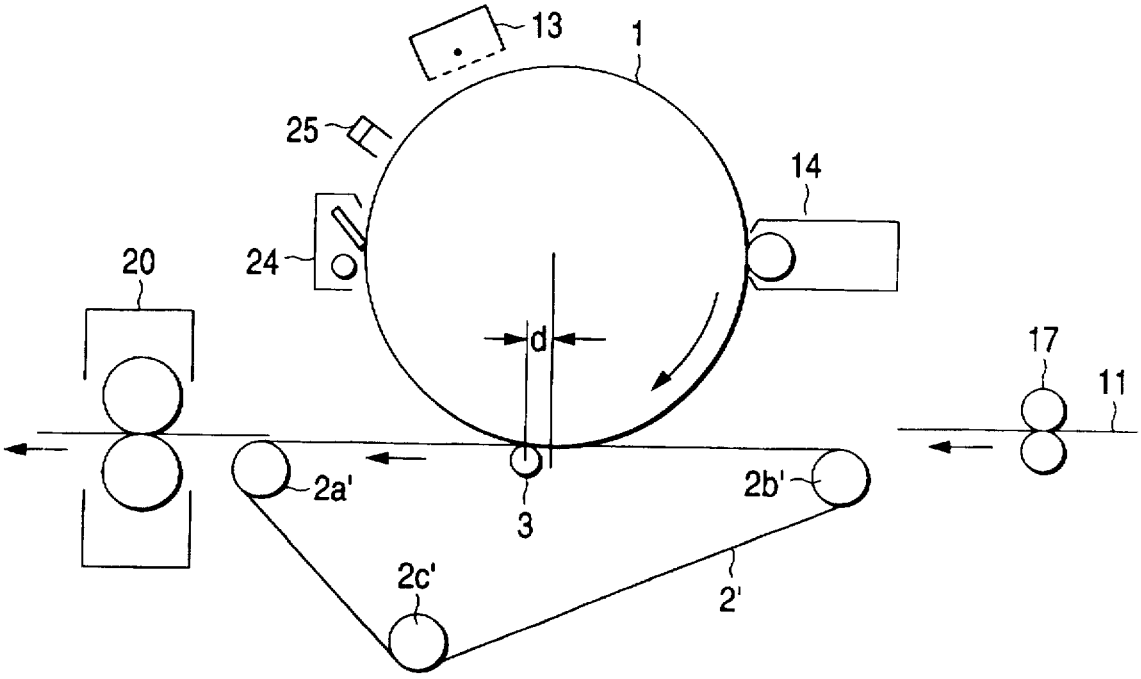
FIG. 8 is a schematic illustration showing an arrangement of the image forming apparatus of the present invention in which a toner image formed on the photoreceptor drum is directly transferred onto a recording medium, wherein a contact transfer member of the invention is applied to this image forming apparatus.

FIG. 8 is a schematic illustration showing an arrangement of the principal portion of the fourth embodiment of the present invention in which a toner image formed on the photoreceptor drum is directly transferred onto a recording medium. Reference numeral 1 is a photoreceptor drum, reference numeral 2' is a transfer belt, and reference numeral 3 is a transfer roller.

Around the photoreceptor drum 1, there are provided a latent image carrier charger (corotron) 13 to uniformly charge a surface of the photoreceptor drum, developing unit 14 to develop a latent image formed on the photoreceptor drum 1, latent image carrier cleaner 24, and discharger 25.

The transfer belt 2' is made of the same material as that of the first embodiment and trained round the drive roller 2a', idle roller 2b' and tension roller 2c'. The transfer belt 2' is conveyed in the direction of arrow.

Reference numeral 11 is a recording medium. After the recording medium 11 has been picked up from a tray not shown in the drawing, it waits for the successive operation at the register roller 17. The recording medium 11 is conveyed to a nip portion, which is a contact portion where the photoreceptor drum 1 is contacted with the transfer belt 2', in timed relation with a toner image carried on the photoreceptor drum 1 rotated to the nip portion.

The transfer roller 3 is arranged at a position in the downstream of the nip portion where the photoreceptor drum 1 is contacted with the transfer belt 2', coming into contact with a reverse side of the transfer belt 2', wherein a distance from the nip portion to the transfer roller 3 is "d".

At the position where the transfer roller 3 is contacted with the transfer belt 2', the photoreceptor drum 1 is separate from the transfer belt 2'.

The distance "d" from the nip portion to the transfer roller 3' is about 0.5 to 2 mm from the center of the nip width in the same manner as that of the above embodiment. The transfer roller 3' is arranged in the downstream of the contact portion where the photoreceptor drum 1 is contacted with the intermediate transfer belt 2', wherein a distance from the contact width center to the transfer roller 3' is 2 to 4 mm. Sizes of the photoreceptor drum 1 and the transfer roller 3' are the same as those of the embodiment described before.

The recording medium 11 onto which the toner image has been transferred is sent to the fixing unit 20 and pressurized or heated/pressurized, so that the image on the recording medium 11 can be fixed.

In this embodiment, image formation of monocolor (black: Bk) is conducted. That is, in this embodiment, a plurality of color toner images are not transferred. However, when the above arrangement is adopted, it is possible to obtain an image of high image quality without increasing the contact pressure of the transfer roller 3 with the transfer belt 2'.

Also, the distance from the latent image carrier to the intermediate transfer body or the transfer belt is maintained to be short. Accordingly, the pressure of the nip portion between them is not increased. As a result, no transfer failure of whitening occurs.

In the same manner as that of the embodiment described before, vibration of the transfer roller is suppressed, and the occurrence of blur in the pre-nip portion can be prevented. Therefore, it is possible to form an image of high image quality.

Figure 9:
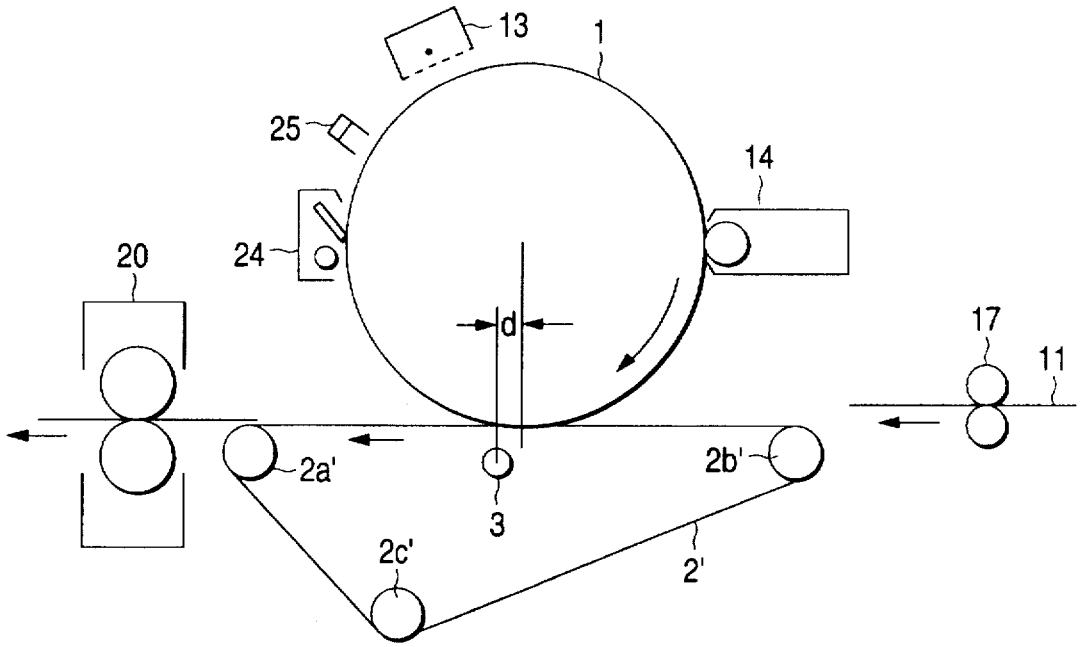
FIG. 9 is a schematic illustration of the image forming apparatus to which the non-contact transfer member shown in FIG. 8 is applied.

FIG. 9 is a schematic illustration showing an arrangement of the principal portion of the fifth embodiment of the present invention in which a toner image formed on the photoreceptor drum is directly transferred onto a recording medium. Except for the structure in which the transfer roller 3 is arranged being not contacted with the transfer belt 2', the structure is the same as that of the fourth embodiment described before. Like reference characters are used to indicate like parts in FIGS. 8 and 9.

In the same manner as that of the embodiment described before, in this embodiment, vibration of the transfer roller is suppressed, and the occurrence of blur in the pre-nip portion can be prevented. Therefore, it is possible to form an image of high image quality.

Figure 10:
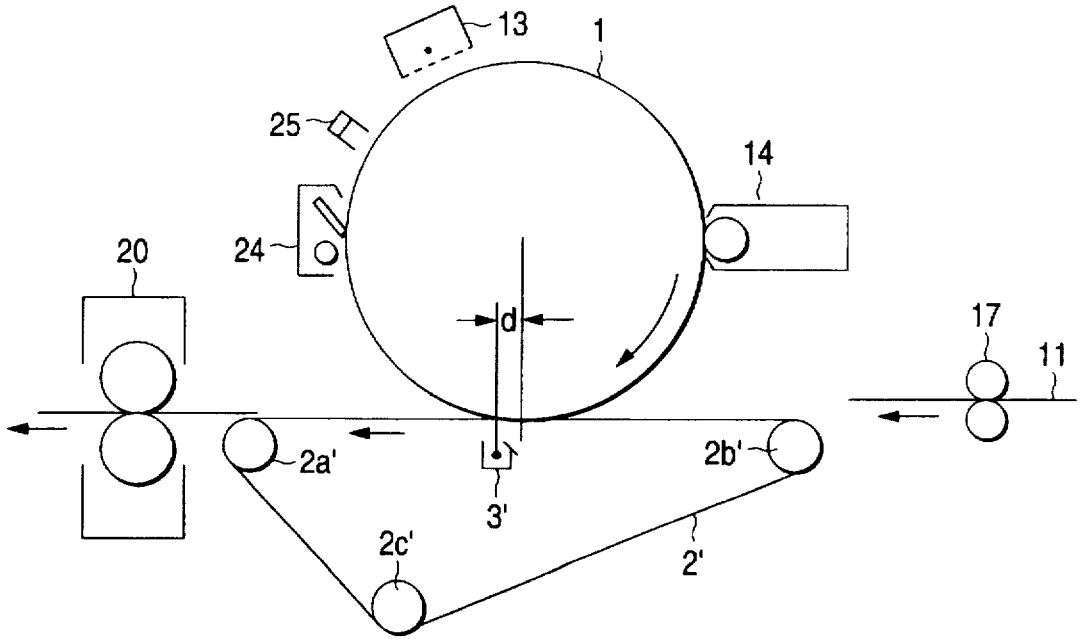
FIG. 10 is a schematic illustration showing an arrangement of the principal portion of the sixth embodiment of the present invention in which a toner image formed on the photoreceptor drum is directly transferred onto a recording medium.

FIG. 10 is a schematic illustration showing an arrangement of the principal portion of the sixth embodiment of the present invention in which a toner image formed on the photoreceptor drum is directly transferred onto a recording medium. Except for the structure in which the corotron 3' is used as a transfer means, the structure is the same as that of the fifth embodiment described before. Like reference characters are used to indicate like parts in FIGS. 8 and 10.

In this embodiment, an electrostatic latent image formed on the photoreceptor drum 1 is developed by toner in the developing unit 14. The corotron 3' is used as a transfer means for transferring this developed toner image onto the recording medium 11 placed on and conveyed by the transfer belt 2'.

The corotron 3' is arranged in the downstream of the nip portion, wherein a distance "d" from the center of the nip portion to the corotron 3' is 2 to 4 mm. The corotron 3' is not contacted with the transfer belt 2'. Therefore, according to this embodiment, vibration of the transfer roller is also suppressed in the same manner as that of the embodiment described before, and no blur is caused in the pre-nip portion, so that image formation of high quality can be conducted.

Figure 11:
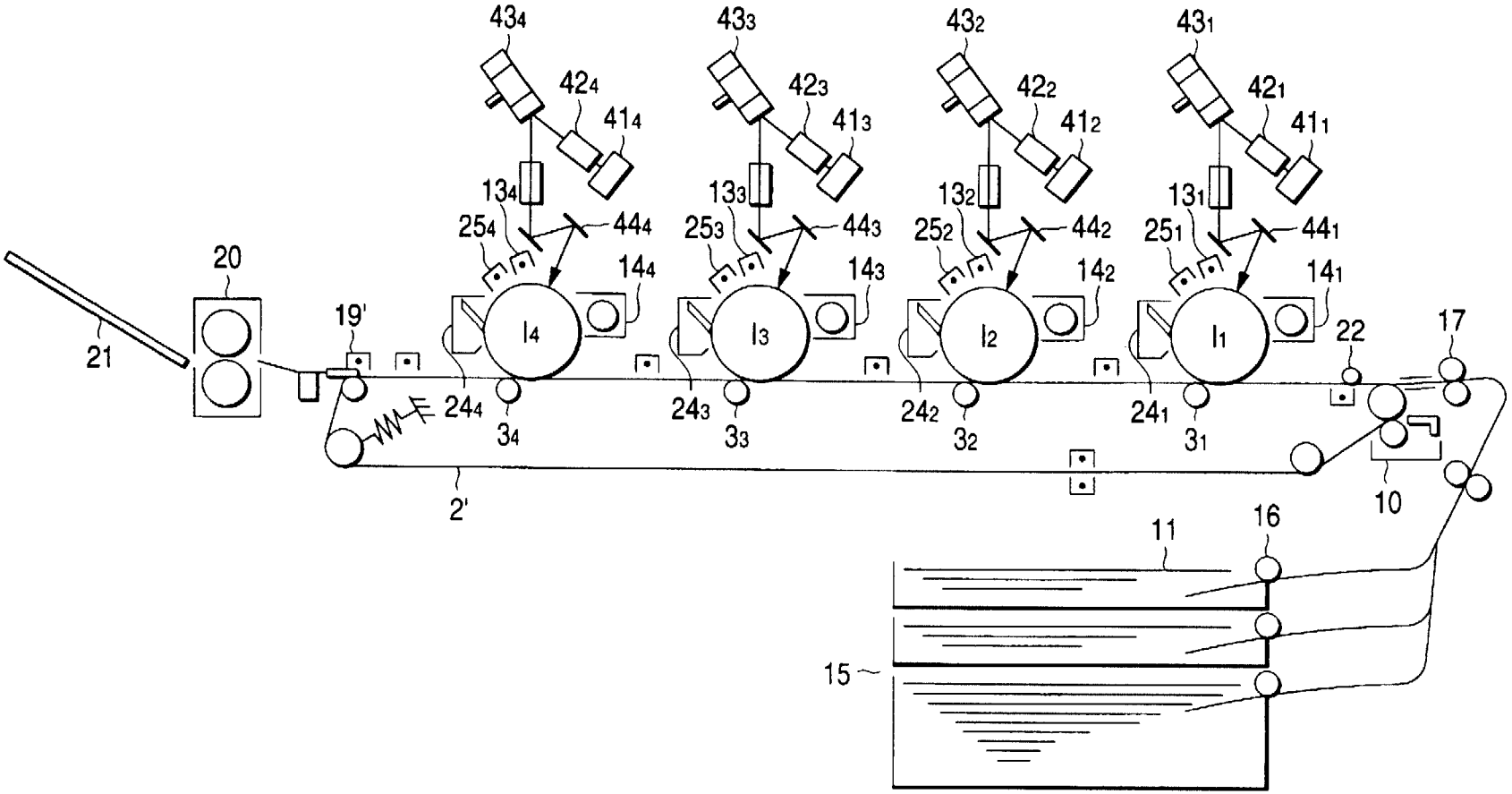
FIG. 11 is a schematic illustration showing an overall arrangement of the seventh embodiment of the present invention which is applied to a color image forming apparatus in which color toner images formed on a plurality of photoreceptor drums are directly superimposed and transferred onto a recording medium.

FIG. 11 is a schematic illustration showing an overall arrangement of the seventh embodiment of the present invention which is applied to a color image forming apparatus in which color toner images formed on a plurality of photoreceptor drums are directly superimposed and transferred onto a recording medium. Reference numeral $1_1$ is a photoreceptor drum of the first color (for example, yellow), reference numeral $1_2$ is a photoreceptor drum of the second color (magenta), reference numeral $1_3$ is a photoreceptor drum of the third color (cyan), reference numeral $1_4$ is a photoreceptor drum of the fourth color (black), reference numeral 2' is a transfer belt, reference numerals $3_1$ to $3_4$ are transfer rollers of the first to the fourth color, reference numeral 10 is a transfer belt cleaner, reference numeral 11 is a recording medium, reference numerals $1_3$ to $13_4$ are latent image carrier chargers, reference numerals $14_1$ to $14_4$ are developing units of the first to the fourth color, reference numeral 15 is a tray, reference numeral 16 is a pickup roller, reference numeral 17 is a register roller, reference numeral 19' is a separation corotron, reference numeral 20 is a fixing unit, reference numeral 21 is a delivery tray, reference numeral 22 is an adsorption roller, reference numerals $24_1$ to $24_4$ are latent image carrier cleaners, $25_1$ to $25_4$ are discharging corotrons, reference numerals $41_1$ to $41_4$ are lasers, reference numerals $42_1$ to $42_4$ are image forming optical systems, reference numerals $43_1$ to $43_4$ are scanning 10 optical systems, and reference numerals $44_1$ to $44_4$ are mirrors.

This embodiment is a tandem type color image forming apparatus in which a plurality of transfer sections having the structure shown in FIG. 4 are aligned along one transfer belt 2', and each transfer section transfers one color so that a plurality of toner images of different colors can be superimposed on one sheet of recording paper.

In the drawing, the photoreceptor drum $1_1$ of the first color is uniformly charged by the latent image carrier charger $13_1$. A latent image is written on the photoreceptor drum $1_1$ of the first color by laser beams which have been modulated by the image signal of the first color (yellow).

The thus written latent image is developed with yellow toner by the developing unit $14_1$, so that the latent image is made to a visual toner image.

After the toner image of the first color has been formed on the photoreceptor drum $1_1$, a toner image of the second color (magenta) is formed on the photoreceptor drum $1_2$ of the second color. Successively, a toner image of the third color (cyan) is formed on the photoreceptor drum $1_3$ of the third color, and a toner image of the fourth color (black) is formed on the photoreceptor drum $1_4$ of the fourth color.

On the other hand, the recording medium 11 is picked up from the tray 15 by the pickup roller 16 and waits for the successive operation at the register roller 17.

When the photoreceptor drum $1_1$ is rotated, a leading end of the toner image formed on its surface advances to a nip portion formed between the photoreceptor drum $1_1$ and the transfer belt 2'. In timed relation with that, the recording medium 11 is released from and conveyed by the register roller 17 to the nip portion.

Each transfer roller $3_1$ to $3_4$ is arranged in the downstream of each nip portion on the reverse side of the transfer belt 2'. In this case, a distance from the nip portion to the transfer roller is maintained at "d".

First, the recording medium 11 onto which the first color toner image has been transferred by the transfer roller $3_1$ is conveyed by the transfer belt 2' and reaches a nip portion formed between the photoreceptor drum $1_2$ of the second color and the transfer belt 2'. At this time, the conveyance speed of the transfer belt 2' and the circumferential speed of the photoreceptor drum $1_2$ are controlled so that the leading end of the first color toner image transferred onto the recording medium 11 can coincide with the leading end of the second color toner image formed on the photoreceptor drum $1_2$ of the second color.

In the same manner, the third color (magenta) toner image formed on the photoreceptor drum $1_3$ of the third color is superimposed on the previously formed toner image by the transfer roller $3_3$, and the fourth color (black) toner image formed on the photoreceptor drum 14 of the fourth color is superimposed on the previously formed toner image by the transfer roller $3_4$.

The recording medium 11 onto which all toner images have been transferred is separated from the transfer belt 2' by the separation corotron 19' and conveyed to the fixing unit 20. In the fixing unit 20, the toner image on the recording medium 11 is pressurized or heated/pressurized so that the toner image can be fixed.

After the toner image has been fixed, the recording medium 11 is delivered onto the delivery tray 21.

In the above arrangement, the transfer rollers $3_1$ to $3_4$ are arranged in the transfer sections formed in the nip portions between the photoreceptor drums $1_1$ to $1_4$ and the transfer belt 2'. In the same manner as that shown before in FIG. 9, these transfer rollers $3_1$ to $3_4$ are arranged in the downstream of the nip portions on the reverse side of the transfer belt 2', wherein each transfer roller is separate from the nip portion by a distance "d".

At the positions where these transfer rollers $3_1$ to $3_4$ come into contact with the transfer belt 2', the transfer belt 2' is separate from the photoreceptor drums $1_1$ to $1_4$.

In the same manner as the above embodiment, the nip width is 0.5 to 2 mm, and the distance "d" from the center of each nip portion to each transfer roller $3_1$ to $3_4$ is 2 to 4 mm, and the transfer roller is arranged in the downstream of each nip portion. The size and material of the photoreceptor drum $1_1$ to $1_4$ and the transfer roller $3_1$ to $3_4$ are the same as those explained in the above embodiment.

According to this embodiment, it is also possible to obtain an image of high quality without increasing the contact pressure of the transfer roller with the transfer belt.

Vibration of the transfer roller can be suppressed, and the occurrence of blur on the transfer image in the pre-nip portion can be prevented. Therefore, it is possible to form an image of high image quality.

Figure 12:
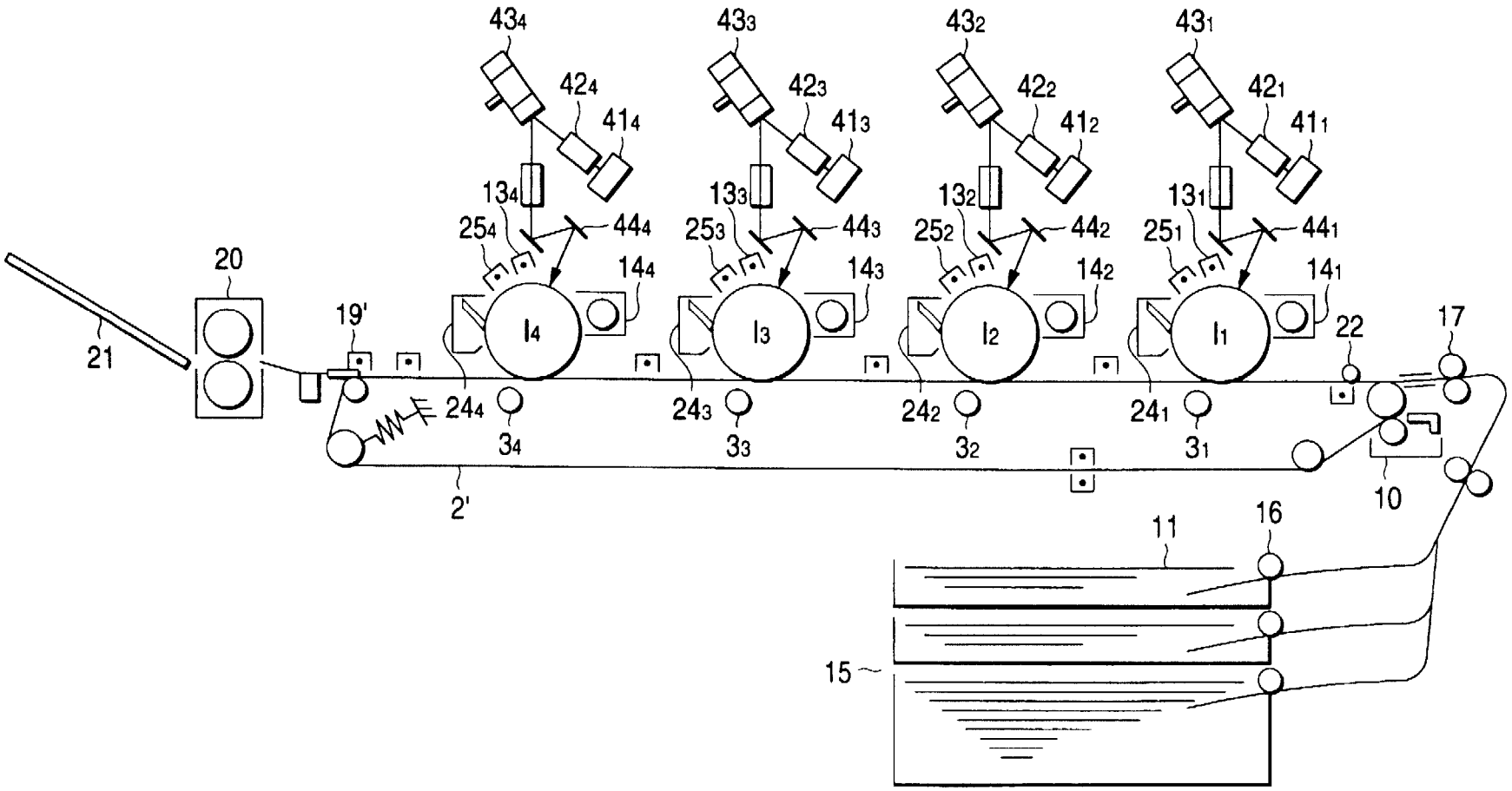
FIG. 12 is a schematic illustration showing an overall arrangement of the eighth embodiment of the present invention in which multicolor toner images formed on a plurality of photoreceptor drums are superimposed and directly transferred onto a recording medium.

FIG. 12 is a schematic illustration showing an overall arrangement of the eighth embodiment of the present invention in which multicolor toner images formed on a plurality of photoreceptor drums are superimposed and directly transferred onto a recording medium. Except for the structure in which the transfer rollers $3_1$ to $3_4$ are arranged on the reverse side of the transfer belt 2' being not contacted with it, the structure is the same as that of the seventh embodiment described before.

According to this embodiment, it is also possible to obtain an image of high quality without increasing the contact pressure of the transfer roller with the transfer belt.

Vibration of the transfer roller can be suppressed, and the occurrence of blur in the pre-nip portion can be prevented. Therefore, it is possible to form an image of high image quality.

Figure 13:
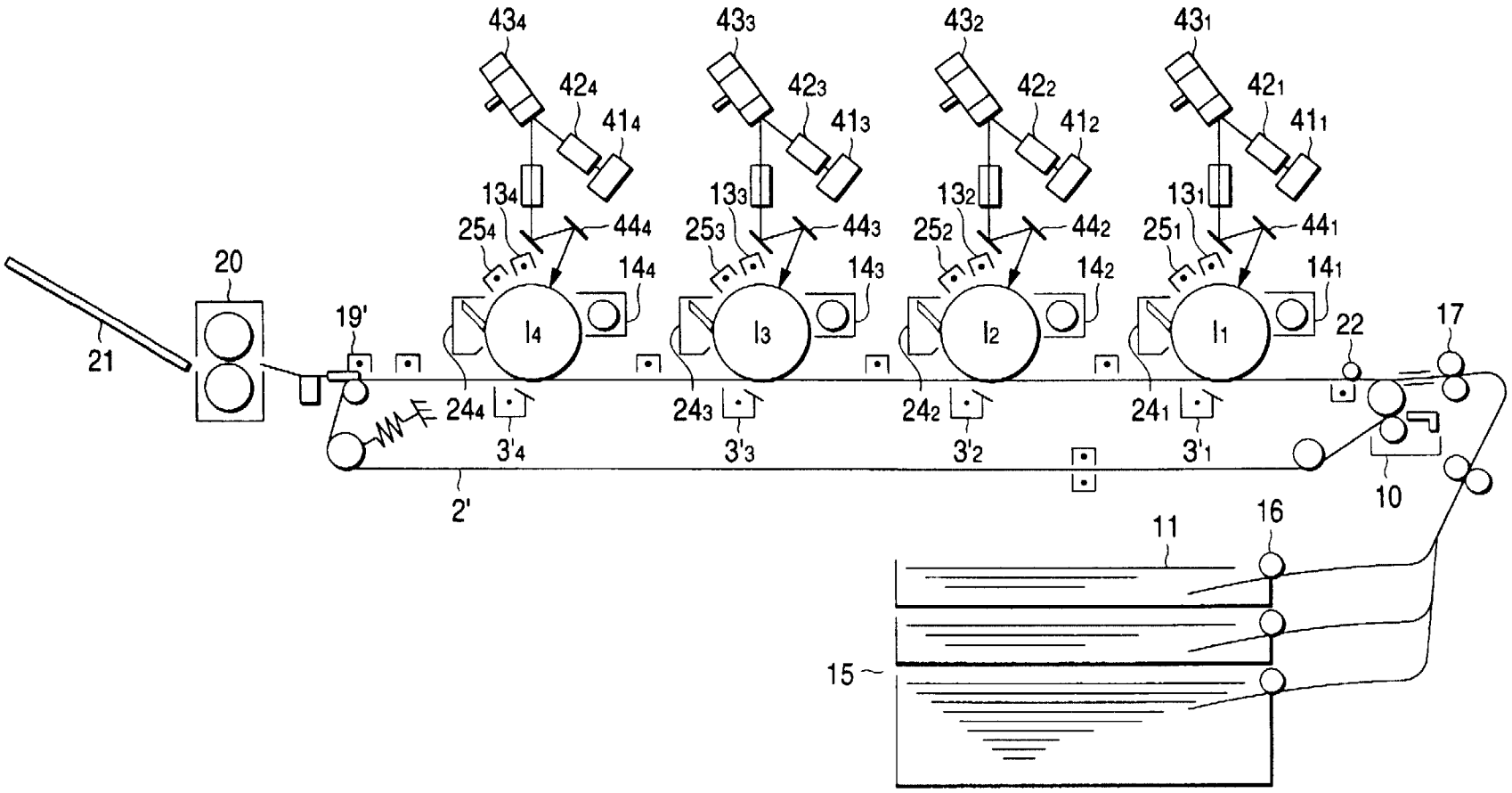
FIG. 13 is a schematic illustration showing an overall arrangement of the ninth embodiment of the present invention in which multicolor toner images formed on a plurality of photoreceptor drums are superimposed and directly transferred onto a recording medium.

FIG. 13 is a schematic illustration showing an overall arrangement of the ninth embodiment of the present invention in which multicolor toner images formed on a plurality of photoreceptor drums are superimposed and directly transferred onto a recording medium. Except for the structure in which the corotron is used for the transfer means, the structure of other components is the same as that of the eighth embodiment described before. Reference numeral 3' is a corotron. Like reference characters are used to indicate like parts in FIGS. 12 and 13.

In this embodiment, electrostatic latent images formed on the photoreceptor drums $1_1$ to $1_4$ are respectively developed with color toners and transferred onto the recording medium 11 conveyed by the transfer belt 2'. As a transfer means for transferring the color toner image onto the recording medium, the corotron 3' is used.

The corotron 3' is arranged at a position in the downstream of the nip portion, wherein a distance "d" from the center of the nip portion to the corotron 3' is 2 to 4 mm. In this case, the corotron 3' is not contacted with the transfer belt 2'.

According to this embodiment, it is also possible to obtain an image of high quality without increasing the contact pressure of the transfer roller with the transfer belt.

In the same manner as the above embodiment, no fluctuation is caused in the transfer electric field of the corotron 3', and no blur is caused in the pre-nip portion. Accordingly, it is also possible to obtain an image of high quality.

In each embodiment described above, the transfer means is arranged in the downstream of the nip portion, and the transfer roller is contacted with the belt member. In the above arrangement, an electric current flows from the transfer roller to the nip portion via the belt member, so that an electric field is formed in the nip portion. By the action of this electric field, the toner image on the latent image carrier can be transferred onto the recording medium.

Since the transfer electric field is formed in the belt member between the transfer nip portion and the transfer roller, toner on the belt member immediately after the completion of transfer is subjected to separation discharge. Therefore, a quantity of electric charge is increased. In this connection, in the case where the transfer roller is arranged not coming into contact with the belt member, the circumstances are the same as described above.

When the photoreceptor drum and the transfer roller are arranged in such a manner that they bite into the belt member, vibration of the photoreceptor drum and the transfer roller is transmitted to the belt member. Accordingly, the stability to drive the belt member is remarkably deteriorated, which causes a failure of banding.

In order to prevent the occurrence of the above problems, the belt member and the transfer roller are substantially arranged on a tangent of the photoreceptor drum.

Figure 14:
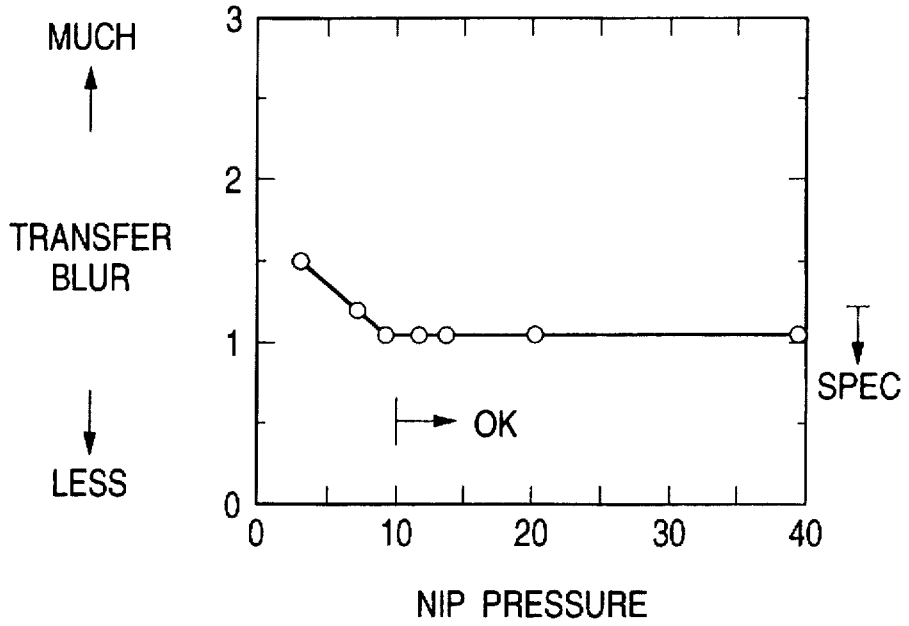
FIG. 14 is a schematic illustration to explain a relation between the pressure in a transfer nip portion and the blur caused when a patch pattern (mottle) is transferred.

FIG. 14 is a schematic illustration to explain a relation between the pressure in a transfer nip portion and the blur caused when a patch pattern (mottle) is transferred. In the drawing, the horizontal axis represents a nip pressure (g/cm) in the nip portion, and the vertical axis represents a degree of blur caused when the pattern is transferred.

Figure 15:
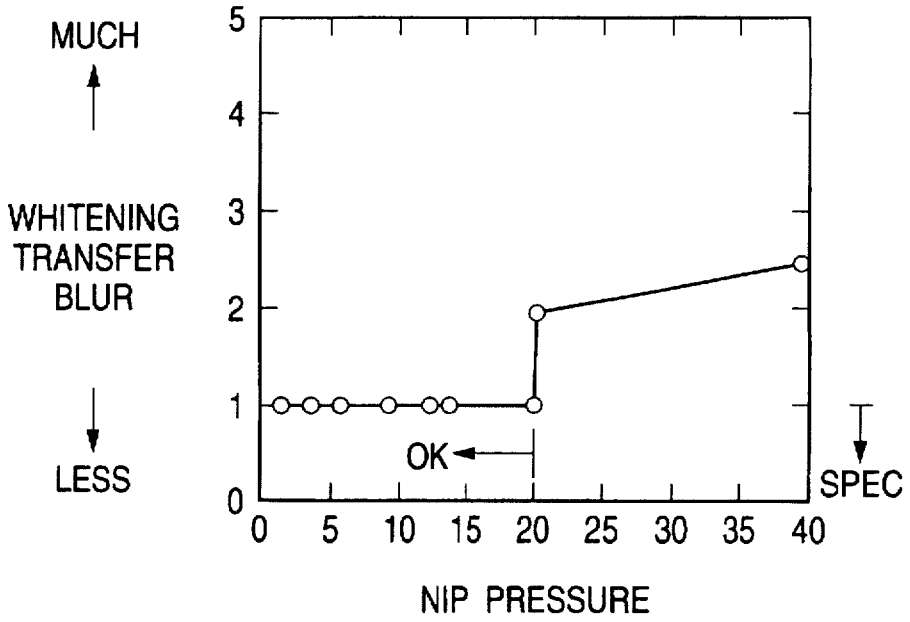
FIG. 15 is a schematic illustration showing a relation between the nip pressure and the transfer blur of whitening.

FIG. 15 is a schematic illustration showing a relation between the nip pressure and the transfer blur of whitening. In the drawing, the horizontal axis represents a nip pressure (g/cm) in the nip portion, and the vertical axis represents a degree of transfer blur (transfer whitening) of the patch pattern.

As shown in FIG. 14, when the nip pressure is not less than 10 g/cm, it is possible to obtain an image of high quality having no transfer blur. As shown in FIG. 15, when the nip pressure is not more than 20 g/cm, it is possible to obtain an image of high quality having no transfer whitening. Accordingly, it is preferable that the nip pressure is maintained at a value not less than 10 g/cm and not more than 20 g/cm.

When the nip pressure between the photoreceptor drum and the belt member is maintained in a range from 10 to 20 g/cm, the nip width between the photoreceptor drum and the belt member becomes 0.5 to 2 mm. At this time, a tension given to the belt member is 3 to 4 kg·f.

From the viewpoint of enhancing the transfer property, it is appropriate to determine the nip width between the photoreceptor drum and the transfer belt to be in a range from 0.5 to 2 mm. In order to transfer a toner image stably, it is necessary to form a nip portion, the width of which is an appropriate value. It is sufficient that the nip width is not less than 0.5 mm. However, when the nip width is excessively large, blur is caused on the transfer image. The reason why blur is caused on the transfer image is described as follows. It is difficult to make the photoreceptor speed to be perfectly the same as the belt member speed. Accordingly, when a large width of the belt member comes into contact with a large width of the photoreceptor drum while there is a difference between the speed of the belt member and the speed of the photoreceptor, image blur is caused in the contact region (nip width).

In an embodiment of the present invention corresponding to the tenth invention, the belt member is not contacted with the photoreceptor drum previously, and when the belt member is raised by the transfer roller, the belt member is made to come into contact with the photoreceptor drum.

Figure 16A:
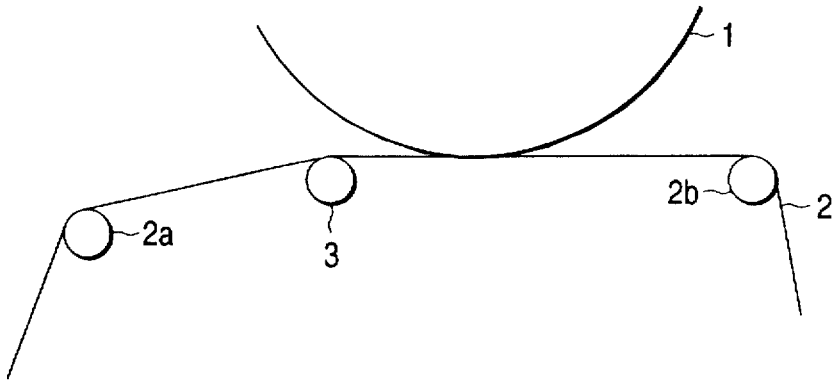
FIGS. 16A and 16B are schematic illustrations to explain the ground of the embodiment corresponding to the tenth invention.
Figure 16B:
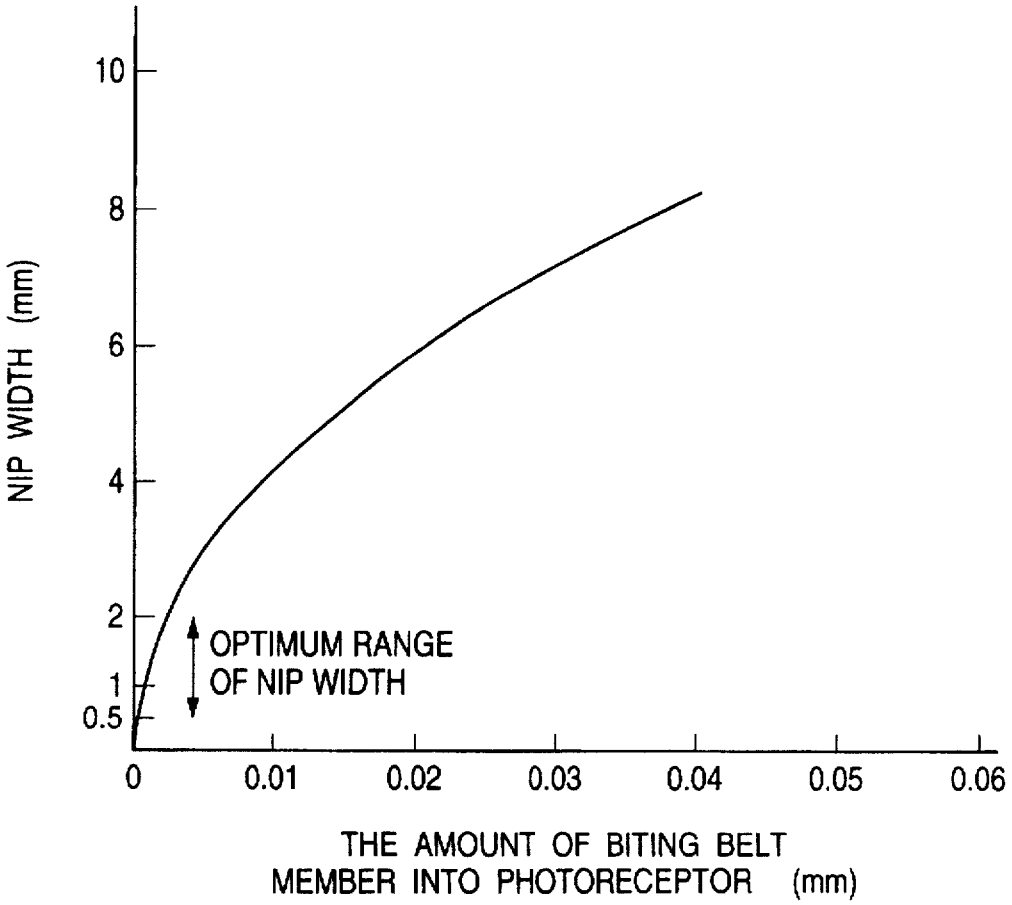

FIGS. 16A and 16B are schematic illustrations to explain the ground of the embodiment corresponding to the tenth invention. FIG. 16A is an arrangement view, and FIG. 16B is a schematic illustration to explain a relation between an amount (mm) of biting of the belt member (transfer belt) into the photoreceptor drum and the nip width (mm).

As shown in FIG. 16A, the belt member 2 is not contacted with the photoreceptor drum 1 when it is provided between the support rollers **2*a* and 2*b***.

After that, when the transfer roller 3 is incorporated into the apparatus, the belt member 2 is pushed up by the transfer roller 3 in the photoreceptor drum direction, so that the belt member 2 can be made to come into contact with the photoreceptor belt 1.

As shown in FIG. 16B, the most appropriate range of the nip width formed between the photoreceptor drum and the belt member is 0.5 to 2 mm. However, it is difficult to maintain the nip width in that range.

For example, when a photoreceptor drum, the diameter of which is 84 mm, is used, in order to provide the above nip width, it is necessary to maintain an amount of biting of the belt member into the photoreceptor drum to be not more than 0.01 mm.

Figure 17:
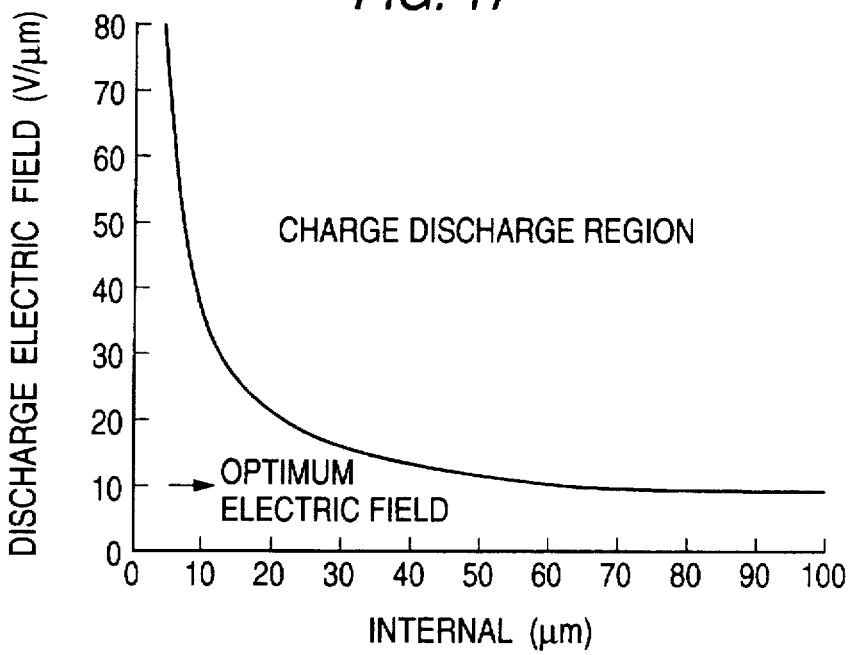
FIG. 17 is a schematic illustration to explain a relation between the breakdown electric field (discharge electric field: V/μm) and the interval which is formed by the belt member and the transfer means when the transfer means is arranged not coming into contact with the belt member.

FIG. 17 is a schematic illustration to explain a relation between the breakdown electric field (discharge electric field: V/μm) and the interval which is formed by the belt member and the transfer means when the transfer means is arranged not coming into contact with the belt member.

FIG. 17 is a view to explain the ground for setting the interval between the belt member (intermediate transfer belt, transfer belt) and the transfer means (transfer roller, corotron) when they are arranged not coming into contact with each other. In this case, it is appropriate to set an intensity of the electric field formed between the belt member and the transfer means to be approximately 10 V/μm.

In this case, the smaller the interval, the lower the transfer voltage to be impressed upon the transfer means for maintaining the above electric field.

However, when the above electric field is maintained and the interval between them is set at a value not less than 100 μm, a voltage to be impressed upon the transfer means exceeds 1 KV. Therefore, electrical discharge occurs between the transfer means and the belt member, and blur is caused on the transferred image.

Accordingly, when the transfer roller is arranged not coming into contact with the belt member, the interval between them must be not more than 100 μm.

When the transfer means is composed of a corotron, an interval between the belt member and the corotron conducting corona discharge may be large. The interval is set at 4 to 10 mm.

In this case, in order to prevent the corona discharge from extending to the pre-nip portion, it is necessary to attach a baffle to a discharge section on the upstream side of the corotron.

In this connection, when a transfer roller is used for the transfer means, it is preferable to use a metallic roller. In order to maintain the interval between the belt member and the transfer roller to be not more than 100 μm with accuracy, it is preferable that a metallic roller manufactured with high machining accuracy is used as the transfer roller. The most appropriate diameter of the metallic roller is not more than 20 mm, and the most preferable material is aluminum or stainless steel (SUS).

A surface of this metallic roller may be covered with resin film of high resistance. When the surface of this metallic roller is covered with resin film of high resistance, it becomes difficult for electric discharge to occur.

Examples of usable resins of high resistance are: PFA, PVdF, nylon, and PC (polycarbonate). Thickness of the high resistance resin film is 30 to 100 μm, and the volume resistivity is $10^4$ to $10^9$ Ω·cm.

In this connection, when the belt member is an intermediate transfer belt, the surface resistivity of the intermediate transfer belt is preferably $10^{11}$ to $10^{13}$ Ω/?. When the surface resistivity is lower than $10^{11}$ Ω/?, the electric charge holding property is lowered, so that the image quality is deteriorated. When the surface resistivity is higher than $10^{13}$ Ω/?, it is difficult for an electric current to flow from the transfer means to the transfer nip portion. Therefore, it becomes impossible to conduct image transfer properly.

As explained above, the present invention can provide the following effects. In an image forming apparatus in which a toner image, not fixed yet, formed on the latent image carrier, is transferred onto a recording medium directly or via an intermediate transfer body, vibration of the transfer roller can be suppressed, and the occurrence of blur in the pre-nip portion can be prevented. Therefore, it is possible to form an image of high quality. In an image forming apparatus in which multi-color toner images are superimposed and transferred, it is possible to prevent the occurrence of transfer whitening and defective transfer caused by a difference of the quantity of electric charge between toner images which are multiply transferred. Accordingly, it is possible to obtain a transfer image of high quality.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

a latent image carrier for forming a latent image in accordance with each image signal of at least one color image;

a developing unit including a plurality of color units with each color unit containing a differently colored toner; the developing unit operative for developing the latent image with at least one predetermined color toner;

a belt member including an intermediate transfer member and arranged in such a manner that a portion of said belt member comes into contact with said latent image carrier, the intermediate transfer member operative to sequentially transfer a toner image appropriate to the latent image of each color of the at least one predetermined color for and carry multiple color latent images as a single laminated toner image, defined as at least two differently colored toner images superimposed on one another; and transfer means for transferring the toner image held on the latent image carrier onto said belt member side, said transfer means being arranged on an opposite side to said latent image carrier with respect to said belt member, wherein said transfer means is arranged in the downstream close to a contact region in which said latent image carrier is contacted with said belt member.

2. The image forming apparatus according to claim 1, wherein said transfer means is arranged at a position where said transfer means is contacted with said belt member.

3. The image forming apparatus according to claim 2, wherein said transfer means is composed of a transfer roller.

4. The image forming apparatus according to claim 3, wherein said belt member is arranged on a tangent shared by said latent image carrier and said transfer means.

5. The image forming apparatus according to claim 3, wherein a volume resistivity of said transfer means is $10^4$ to $10^9$ Ω·cm.

6. The image forming apparatus according to claim 2, wherein a surface of said belt member opposing to said electrostatic latent image carrier is extended by an extending means under the condition that the surface is not contacted with said electrostatic latent image carrier, and the surface is contacted with said electrostatic latent image carrier when said transfer means is pushed to said belt member.

7. The image forming apparatus according to claim 1, wherein said transfer means is arranged at a position where said transfer means is opposed to said belt member being not contacted with said belt members.

8. The image forming apparatus according to claim 7, wherein said transfer means comprises a transfer roller.

9. The image forming apparatus according to claim 7, wherein said transfer means comprises a corotron.

10. The image forming apparatus according to claim 9, wherein a baffle plate to prevent an electric field from extending into a contact start region of said electrostatic latent image carrier with said belt member is arranged at a position in the upstream of said belt member movement where the corotron is opposed to said belt member.

11. The image forming apparatus according to claim 7, wherein a distance from said belt members to said transfer means is determined to be not more than 100 μm.

12. The image forming apparatus according to claim 11, wherein said transfer means is composed of a metallic roller.

13. The image forming apparatus according to claim 12, wherein a surface of said metallic roller is covered with a resin layer, the electric resistance of which is high.

14. The image forming apparatus according to claim 1, wherein a contact pressure of said latent image carrier with said belt member is maintained at 10 to 20 g/cm.

15. The image forming apparatus according to claim 1, wherein a distance from the center of a contact point of said latent image carrier with said belt member to the center of a contact point of said belt member with said transfer means is determined to be 2 to 4 mm, or alternatively a distance from the center of a contact point of said latent image carrier with said belt member to the center of a non-contact opposing point of said belt member and said transfer means is determined to be 2 to 4 mm.

16. A color image forming apparatus, comprising:

a plurality of photoreceptor drums respectively forming a latent image in accordance with each image signal of a plurality of color images;

a plurality of color developing units respectively provided to the plurality of photoreceptor drums so as to develop each latent image with a predetermined color toner;

a transfer belt coming into contact with each photoreceptor drum so that said transfer belt can be rotated together with said photoreceptor drum, said transfer belt being capable of conveying a recording medium onto which each color toner image formed on each photoreceptor drum is successively transferred; and a plurality of transfer rollers arranged in the downstream close to a contact region of respective ones of said photoreceptor drums with said transfer belt, said transfer rollers being not contacted with said transfer belt to form a transfer electric field between said photoreceptor drum and said transfer belt when a voltage, the polarity of which is opposite to the electrical charging polarity of the toner image, is impressed upon a reverse side to a recording medium holding surface of said transfer belt.

* * * * *